US007723925B2

(12) United States Patent
Mosebrook et al.

(10) Patent No.: US 7,723,925 B2
(45) Date of Patent: May 25, 2010

(54) MULTIPLE LOCATION DIMMING SYSTEM

(75) Inventors: Donald Mosebrook, Coopersburg, PA (US); Daniel F. Carmen, Schnecksville, PA (US); Christopher Buck, Bethlehem, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 982 days.

(21) Appl. No.: 11/471,908

(22) Filed: Jun. 20, 2006

(65) Prior Publication Data

US 2007/0296347 A1 Dec. 27, 2007

(51) Int. Cl.
*H05B 41/16* (2006.01)

(52) U.S. Cl. ..... 315/246

(58) Field of Classification Search ..... 315/209 R, 315/246, DIG. 4
See application file for complete search history.

(56) References Cited

U.S. PATENT DOCUMENTS

| | | | | |
|---|---|---|---|---|
| 3,697,821 | A | 10/1972 | Johnson | |
| 4,259,619 | A | 3/1981 | Wall | |
| 4,334,171 | A | 6/1982 | Parman et al. | |
| 4,563,592 | A * | 1/1986 | Yuhasz et al. | 307/115 |
| 4,689,547 | A | 8/1987 | Rowen et al. | |
| 4,745,351 | A | 5/1988 | Rowen et al. | |
| 4,841,221 | A | 6/1989 | Barney et al. | |
| 4,949,012 | A * | 8/1990 | Irick et al. | 315/82 |
| 5,248,919 | A | 9/1993 | Hanna et al. | |
| 5,350,977 | A * | 9/1994 | Hamamoto et al. | 315/291 |
| 5,504,400 | A * | 4/1996 | Dalnodar | 315/291 |
| 5,506,480 | A * | 4/1996 | Carlson et al. | 315/292 |
| 5,519,263 | A | 5/1996 | Santana, Jr. | |
| 5,798,581 | A | 8/1998 | Keagy et al. | |
| 6,313,588 | B1 | 11/2001 | Mosebrook et al. | |

(Continued)

FOREIGN PATENT DOCUMENTS

DE 10 2004 055 748 2/2006

(Continued)

OTHER PUBLICATIONS

Cooper Wiring Devices, "Aspire Catalog," 2004, 12 pages.

(Continued)

*Primary Examiner*—Douglas W Owens
*Assistant Examiner*—Minh D A
(74) *Attorney, Agent, or Firm*—Ostrolenk Faber LLP

(57) ABSTRACT

A multiple location dimming system comprises a plurality of dimmers coupled between an AC power source and a lighting load. Each of the plurality of dimmers is operable to control the intensity of the lighting load and comprises a controllably conductive device, e.g., a triac. The triacs of the plurality of dimmers are coupled in parallel electrical connection. Only an active one of the dimmers is operable to conduct a load current to the lighting load at any given time. A passive dimmer is operable to monitor the voltage across its triac in order to determine when the active dimmer is firing its triac. Accordingly, the passive dimmer is operable to fire its triac before the active dimmer fires its triac in order to "take over" control of the lighting load from the active dimmer to become the next active dimmer. Further, the passive dimmer is operable to determine the amount of power being delivered to the load and display this information on one or more status indicators.

21 Claims, 16 Drawing Sheets

U.S. PATENT DOCUMENTS

| | | | | |
|---|---|---|---|---|
| 6,346,781 | B1 | 2/2002 | Mosebrook et al. | |
| 6,980,122 | B2 | 12/2005 | Novikov | |
| 6,987,449 | B2 | 1/2006 | Novikov | |
| 7,012,518 | B2 | 3/2006 | Novikov | |
| 7,411,359 | B2 * | 8/2008 | Chung et al. | 315/291 |
| 7,417,384 | B2 | 8/2008 | Adamson et al. | 315/291 |
| 2004/0206616 | A1 | 10/2004 | Leopold et al. | |

FOREIGN PATENT DOCUMENTS

| | | |
|---|---|---|
| EP | 1 158 841 | 11/2001 |
| FR | 2 848 376 | 12/2002 |
| GB | 2 343 796 | 5/2000 |
| WO | WO 95/10928 | 4/1995 |
| WO | WO 2006/133168 | 12/2006 |

OTHER PUBLICATIONS

Leviton Manufacturing Co., Inc., Acenti Product Specifications, 2004, 12 pages.

PCT International Preliminary Report on Patentability and Written Opinion dated Jan. 8, 2009, in connection with the corresponding PCT Application No. PCT/US2007/014235.

Search Report issued by PCT in connection with corresponding application No. PCT/US2007/014235 on Dec. 6, 2007.

* cited by examiner

MULTIPLE LOCATION DIMMING SYSTEM

BACKGROUND OF THE INVENTION

1. Field of the Invention

The present invention relates to multiple location dimming systems having multiple smart dimmers, for example, a three-way dimming system that includes smart dimmer switches at both locations of the three-way system. In particular, all of the smart dimmers in the multiple location dimming system according to the present invention are operable to carry the same load current to control one or more lighting loads in unison and to display a present intensity level of the lighting load(s) on a status indicator.

2. Description of the Related Art

Three-way and four-way switch systems for use in controlling loads in buildings, such as lighting loads, are known in the art. Typically, the switches used in these systems are wired to the building's alternating-current (AC) wiring system, are subjected to AC source voltage, and carry full load current, as opposed to low-voltage switch systems that operate at low voltage and low current, and communicate digital commands (usually low-voltage logic levels) to a remote controller that controls the level of AC power delivered to the load in response to the commands. Thus, as used herein, the terms "three-way switch", "three-way system", "four-way switch", and "four-way system" mean such switches and systems that are subjected to the AC source voltage and carry the full load current.

A three-way switch derives its name from the fact that it has three terminals and is more commonly known as a single-pole double-throw (SPDT) switch, but will be referred to herein as a "three-way switch". Note that in some countries a three-way switch as described above is known as a "two-way switch".

A four-way switch is a double-pole double-throw (DPDT) switch that is wired internally for polarity-reversal applications. A four-way switch is commonly called an intermediate switch, but will be referred to herein as a "four-way switch".

In a typical, prior art three-way switch system, two three-way switches control a single load, and each switch is fully operable to independently control the load, irrespective of the status of the other switch. In such a system, one three-way switch must be wired at the AC source side of the system (sometimes called "line side"), and the other three-way switch must be wired at the load side of the system.

FIG. 1A shows a standard three-way switch system 100, which includes two three-way switches 102, 104. The switches 102, 104 are connected between an AC voltage source 106 and a lighting load 108. The three-way switches 102, 104 each include "movable" (or common) contacts, which are electrically connected to the AC voltage source 106 and the lighting load 108, respectively. The three-way switches 102, 104 also each include two fixed contacts. When the movable contacts are making contact with the upper fixed contacts, the three-way switches 102, 104 are in position A in FIG. 1A. When the movable contacts are making contact with the lower fixed contact, the three-way switches 102, 104 are in position B. When the three-way switches 102, 104 are both in position A (or both in position B), the circuit of system 100 is complete and the lighting load 108 is energized. When switch 102 is in position A and switch 104 is in position B (or vice versa), the circuit is not complete and the lighting load 108 is not energized.

Three-way dimmer switches that replace three-way switches are known in the art. An example of a three-way dimmer switch system 150, including one prior art three-way dimmer switch 152 and one three-way switch 104 is shown in FIG. 1B. The three-way dimmer switch 152 includes a dimmer circuit 152A and a three-way switch 152B. A typical, AC phase-control dimmer circuit 152A regulates the amount of energy supplied to the lighting load 108 by conducting for some portion of each half-cycle of the AC waveform, and not conducting for the remainder of the half-cycle. Because the dimmer circuit 152A is in series with the lighting load 108, the longer the dimmer circuit conducts, the more energy will be delivered to the lighting load 108. Where the lighting load 108 is a lamp, the more energy that is delivered to the lighting load 108, the greater the light intensity level of the lamp. In a typical dimming operation, a user may adjust a control to set the light intensity level of the lamp to a desired light intensity level. The portion of each half-cycle for which the dimmer conducts is based on the selected light intensity level. The user is able to dim and toggle the lighting load 108 from the three-way dimmer switch 152 and is only able to toggle the lighting load from the three-way switch 104. Since two dimmer circuits cannot be wired in series, the three-way dimmer switch system 150 can only include one three-way dimmer switch 152, which can be located on either the line side or the load side of the system.

A four-way switch system is required when there are more than two switch locations from which to control the load. For example, a four-way system requires two three-way switches and one four-way switch, wired in well known fashion, so as to render each switch fully operable to independently control the load irrespective of the status of any other switches in the system. In the four-way system, the four-way switch is required to be wired between the two three-way switches in order for all switches to operate independently, i.e., one three-way switch must be wired at the AC source side of the system, the other three-way switch must be wired at the load side of the system, and the four-way switch must be electrically situated between the two three-way switches.

FIG. 1C shows a prior art four-way switching system 180. The system 180 includes two three-way switches 102, 104 and a four-way switch 185. The four-way switch 185 has two states. In the first state, node A1 is connected to node A2 and node B1 is connected to node B2. When the four-way switch 185 is toggled, the switch changes to the second state in which the paths are now crossed (i.e., node A1 is connected to node B2 and node B1 is connected to node A2). Note that a four-way switch can function as a three-way switch if one terminal is simply not connected.

FIG. 1D shows another prior art switching system 190 containing a plurality of four-way switches 185. As shown, any number of four-way switches can be included between the three-way switches 102, 104 to enable multiple location control of the lighting load 108.

Multiple location dimming systems employing a smart dimmer switch and a specially designed remote (or "accessory") switch that permit the dimming level to be adjusted from multiple locations have been developed. A smart dimmer is one that includes a microcontroller or other processing means for providing an advanced set of control features and feedback options to the end user. For example, the advanced features of a smart dimmer may include a protected or locked lighting preset, fading, and double-tap to full intensity. To power the microcontroller, smart dimmers include power supplies, which draw a small amount of current through the lighting load each half-cycle when the semiconductor switch is non-conducting. The power supply typically uses this small amount of current to charge a storage capacitor and develop a direct-current (DC) voltage to power the microcontroller. An example of a multiple location lighting control system, including a wall-mountable smart dimmer switch and wall-mountable remote switches for wiring at all locations of a multiple location dimming system, is disclosed in commonly assigned U.S. Pat. No. 5,248,919, issued on Sep. 28, 1993, entitled LIGHTING CONTROL DEVICE, which is herein incorporated by reference in its entirety.

Referring again to the system 150 of FIG. 1B, since no load current flows through the dimmer circuit 152A of the three-way dimmer switch 152 when the circuit between the supply 106 and the lighting load 108 is broken by either three-way switch 152B or 104, the dimmer switch 152 is not able to include a power supply and a microcontroller. Thus, the dimmer switch 152 is not able to provide the advanced set of features of a smart dimmer to the end user.

FIG. 2 shows an example multiple location lighting control system 200 including one wall-mountable smart dimmer switch 202 and one wall-mountable remote switch 204. The dimmer switch 202 has a Hot (H) terminal for receipt of an AC source voltage provided by an AC power supply 206, and a Dimmed Hot (DH) terminal for providing a dimmed-hot (or phase-controlled) voltage to a lighting load 208. The remote switch 204 is connected in series with the DH terminal of the dimmer switch 202 and the lighting load 208, and passes the dimmed-hot voltage through to the lighting load 208.

The dimmer switch 202 and the remote switch 204 both have actuators to allow for raising, lowering, and toggling on/off the light intensity level of the lighting load 208. The dimmer switch 202 is responsive to actuation of any of these actuators to alter the dimming level (or power the lighting load 208 on/off) accordingly. In particular, actuation of an actuator at the remote switch 204 causes an AC control signal, or partially rectified AC control signal, to be communicated from that remote switch 204 to the dimmer switch 202 over the wiring between the Accessory Dimmer (AD) terminal of the remote switch 204 and the AD terminal of the dimmer switch 202. The dimmer switch 202 is responsive to receipt of the control signal to alter the dimming level or toggle the load 208 on/off. Thus, the load can be fully controlled from the remote switch 204.

The user interface of the dimmer switch 202 of the multiple location lighting control system 200 is shown in FIG. 3. As shown, the dimmer switch 202 may include a faceplate 310, a bezel 312, an intensity selection actuator 314 for selecting a desired level of light intensity of a lighting load 208 controlled by the dimmer switch 202, and a control switch actuator 316. The faceplate 310 need not be limited to any specific form, and is preferably of a type adapted to be mounted to a conventional wall-box commonly used in the installation of lighting control devices. Likewise, the bezel 312 and the actuators 314, 316 are not limited to any specific form, and may be of any suitable design that permits manual actuation by a user.

An actuation of the upper portion 314A of the actuator 314 increases or raises the light intensity of the lighting load 208, while an actuation of the lower portion 314B of the actuator 314 decreases or lowers the light intensity. The actuator 314 may control a rocker switch, two separate push switches, or the like. The actuator 316 may control a push switch, though the actuator 316 may be a touch-sensitive membrane. The actuators 314, 316 may be linked to the corresponding switches in any convenient manner. The switches controlled by actuators 314, 316 may be directly wired into the control circuitry to be described below, or may be linked by an extended wired link, infrared (IR) link, radio frequency (RF) link, power line carrier (PLC) link, or otherwise to the control circuitry.

The dimmer switch 202 may also include an intensity level indicator in the form of a plurality of light sources 318, such as light-emitting diodes (LEDs). Light sources 318 may be arranged in an array (such as a linear array as shown) representative of a range of light intensity levels of the lighting load 208 being controlled. The intensity levels of the lighting load 208 may range from a minimum intensity level, which is preferably the lowest visible intensity, but which may be "full off", or zero, to a maximum intensity level, which is typically "full on", or substantially 100%. Light intensity level is typically expressed as a percent of full intensity. Thus, when the lighting load 208 is on, light intensity level may range from 1% to substantially 100%.

The system shown in FIG. 2 provides a fully functional three-way switching system wherein the user is able to access all functions, such as, for example, dimming at both locations. However, in order to provide this functionality, both switching devices need to be replaced with the respective devices 202, 204. Further, since the remote switch 204 does not have LEDs, no feedback can be provided to a user at the remote switch 204.

Sometimes it is desired to place only one smart switch in the three-way or four-way switching circuit. As shown in FIG. 1B, it is not possible heretofore to do this by simply replacing the dimmer 152 with a smart dimmer, leaving mechanical three-way switch 104 in the circuit because when switch 104 breaks the circuit, power no longer is provided to the microcontroller of the smart dimmer (in place of the dimmer 152) because current no longer flows through the dimmer to the lighting load 108. The three-way and four-way dimmer switch according to the present invention provides a solution to this problem and also optionally provides a means for remote control of the switch.

In one prior art remote control lighting control system, a single multi-location dimmer and up to nine "accessory" dimmers can be installed on the same circuit to enable dimming from a plurality of controls. In the prior art, accessory dimmers are necessary because prior art multi-location dimmers are incompatible with mechanical three-way switches. Accessory dimmers installed throughout a house can greatly increase the cost of the components and of the installation of a dimming system.

Moreover, even though the multiple location lighting control system 200 allows for the use of a smart dimmer switch in a three-way system, it is necessary for the customer to purchase the remote switch 204 along with the smart dimmer switch 202. Often, the typical customer is unaware that a remote switch is required when buying a smart dimmer switch for a three-way or four-way system until after the time of purchase when the smart dimmer switch is installed and it is discovered that the smart dimmer switch will not work properly with the existing mechanical three-way or four-way switch. Therefore, there exists a need for a smart dimmer that may be installed in any location of a three-way or four-way system without the need to purchase and install a special remote switch.

Smart dimmers that are operable to be installed in a three-way system in place of one of the three-way switches are known. FIG. 4A shows a prior art three-way system 400 having a smart three-way dimmer 402 and FIG. 4B shows a prior art three-way system 450 having a smart three-way dimmer 452. The smart three-way dimmers 402, 452 are described in greater detail in co-pending, commonly-assigned U.S. patent application Ser. No. 11/447,496, filed Jun. 6, 2006, entitled DIMMER SWITCH FOR USE WITH LIGHTING CIRCUITS HAVING THREE-WAY SWITCHES, the entire disclosure of which is hereby incorporated by reference in its entirety. Note that the dimmers 402, 452 may be coupled on either the line-side or the load-side of the three-way systems 400, 452.

The smart dimmer 402 comprises a first dimmer circuit 410 coupled between an AC source 406 and the first fixed contact A of a standard three-way switch 404 and a second dimmer circuit 412 coupled between the AC source and the second fixed contact B of the three-way switch 404. The movable contact of the three-way switch 404 is coupled to a lighting load 408. The smart dimmer comprises a control circuit 414 coupled across the dimming circuits 410, 412 via two diodes 416. The control circuit 414 comprises a power supply, which is operable to charge through the lighting load 408 via one of the diodes 416 depending upon the position of the movable contact of the three-way switch 404. Preferably, the control circuit is operable to determine whether the three-way switch 404 is in position A or position B depending upon whether a voltage is developed across the first dimmer circuit 410 or the second dimmer circuit 412, respectively. The smart three-way dimmer 402 is operable to provide feedback to a user of the intensity of the lighting load 408.

The smart dimmer 452 only comprises a single dimmer circuit 460 coupled between the AC source 406 and the first fixed contact A of the three-way switch 404. The smart dimmer also comprises a control circuit 464 coupled across the dimmer circuit 462 and a current sense circuit 468 coupled between the first fixed contact A and the second fixed contact B of the three-way switch 404. The control circuit 462 includes a power supply that is operable to charge through lighting load 408. The control circuit 464 is operable to determine whether the three-way switch 404 is in position A or position B in response to a control signal generated by the current sense circuit 468. The control signal is provided to the control circuit 464 when the current sense circuit 468 senses the charging current of the power supply flowing through the second fixed contact B of the three-way switch 404. The smart three-way dimmer 452 is operable to provide feedback to a user of the intensity of the lighting load 408.

However, the three-way systems 400, 450 cannot include more than one smart dimmer 402, 452. Therefore, there is a need for a three-way system that is operable to include a smart dimmer at both locations of the three-way system. Further, there is a need for a multiple location dimming system having identical dimmers that wire in each location of the dimming system and that each have status indicators.

SUMMARY OF THE INVENTION

According to the present invention, a multiple location dimming system for controlling the power delivered to an electrical load from an AC power source comprises a first dimmer and a second dimmer. The first dimmer is coupled between the AC power source and the electrical load and comprises a first controllably conductive device for controlling the amount of power delivered to the electrical load. The second dimmer is coupled between the AC power source and the electrical load and comprises a second controllably conductive device for controlling the amount of power delivered to the electrical load. The first dimmer is coupled to the second dimmer such that the first controllably conductive device is coupled in parallel electrical connection with the second controllably conductive device. The parallel combination of the first and second controllably conductive devices in series electrical connection between the AC power source and the electrical load. Preferably, a second controller of the second dimmer is operable to monitor a second dimmer electrical characteristic in order to determine a first time when the first controllably conductive device of the first dimmer is rendered conductive. Further, the second controller is operable to render the second controllably conductive device conductive at a second time before the first time.

Further, the present application provides a multiple location dimming system for controlling the power delivered to an electrical load from an AC power source comprising first and second dimmers. The first dimmer is coupled between the AC power source and the electrical load and comprises a first controllably conductive device operable to control the amount of power delivered to the electrical load by conducting load current from the AC power source to the electrical load at a first time each half-cycle of the AC power source. The second dimmer is coupled between the AC power source and the electrical load and comprises a second controllably conductive device operable to control the amount of power delivered to the electrical load. The second dimmer is coupled to the first dimmer such that the second controllably conductive device is coupled in parallel electrical connection with the first controllably conductive device. The parallel combination of the first and second controllably conductive devices are in series electrical connection between the AC power source and the electrical load. Only one of the first and the second controllably conductive devices is operable to conduct the load current at a given time. The second dimmer is operable to render the second controllably conductive device conductive at a second time before the first time. The first dimmer is operable to render the first controllably conductive device non-conductive in response to the second dimmer rendering the second controllably conductive device conductive at the second time.

According to another embodiment of the present invention, a multiple location dimming system for controlling the power delivered to an electrical load from an AC power source comprises a first dimmer coupled to the AC power source. The first dimmer comprises a first controllably conductive device for controlling the amount of power delivered to the electrical load. The system further comprises a second dimmer coupled to the electrical load. The second dimmer comprises a second controllably conductive device for controlling the amount of power delivered to the electrical load. The first and second dimmers each comprise at least one status indicator for displaying a status of the electrical load.

In addition, the present invention provides a load control device for controlling the amount of power delivered to an electrical load from an AC power source. The load control device comprises a first controllably conductive device, a sensing circuit, and a first controller. The first controllably conductive device has a control input and is coupled in series electrical connection between the AC power source and the electrical load for controlling the amount of power delivered to the electrical load. The sensing circuit is operable to provide a control signal representative of a first electrical characteristic of the load control device. The first controller is coupled to the control input of the first controllably conductive device and is operable to receive the control signal from the sensing circuit. The load control device is operable to be coupled to a second load control device having a second controllably conductive device. The second controllably conductive device is coupled in parallel electrical connection with the first controllably conductive device. The first controller is operable to determine when the second controllably conductive device is changed between a non-conductive state and a conductive state in response to the control signal from the sensing circuit.

The present invention further provides a load control device for controlling the amount of power delivered to an electrical load from an AC power source. The load control device comprises a controllably conductive device coupled in series electrical connection between the AC power source and the electrical load for controlling the amount of power delivered to the load by conducting current to the electrical load for a first period of time each half-cycle of the AC power source. The controllably conductive device has a control input. The load control device also comprises a voltage monitoring circuit coupled in parallel with the controllably conductive device and operable to provide a control signal representative of a voltage developed across the controllably conductive device. The load control device further comprises a controller coupled to the control input of the controllably conductive device and operable to receive the control signal from the voltage monitoring circuit. The controller is operable to determine whether the voltage across the controllably conductive device is a substantially low voltage at approximately the beginning of the first period of time.

According to another aspect of the present invention, a first dimmer switch is adapted to be coupled to a circuit including a power source, an electrical load, and a second dimmer switch. The first dimmer switch comprises a controllably conductive device operable to control the amount of power delivered from the power source to the electrical load; a sensing circuit coupled across the controllably conductive device for generating a control signal representative of an electrical characteristic of the first dimmer switch; and a controller operatively coupled to the controllably conductive device for controlling the amount of power delivered to the load. The controller is operable to change the controllably conductive device between an active mode, in which the controllably conductive device is conducting the load current, and a passive mode, in which the controllably conductive device is not conducting the load current, in response to the control signal of the sensing circuit.

The present invention further provides a method of controlling the amount of power delivered to an electrical load from an AC power source. The method comprises the steps of coupling a first controllably conductive device between the AC power source and the electrical load, and coupling a second controllably conductive device between the AC power source and the electrical load and in parallel electrical connection with the first controllably conductive device. The method further comprises the step of controlling the first controllably conductive device to be conductive for at a first time each half-cycle of the AC power source. Alternatively, the method may comprise the step of controlling the first controllably conductive device to be conductive for a first period of time each half-cycle of the AC power source.

According to another embodiment of the present invention, a method of controlling the amount of power delivered to an electrical load from an AC power source comprises the steps of coupling a plurality of controllably conductive devices between the AC power source and the electrical load with the plurality of controllably conductive devices being coupled in parallel electrical connection, and selectively controlling one of the plurality of controllably conductive devices to be conductive for a period of time each half-cycle of the AC power source.

The invention further provides a multiple location dimming system for controlling the power delivered to an electrical load from an AC power source, comprising a plurality of dimmers wired in parallel electrical connection. Each dimmer operates independently or with the other dimmers to control the amount of power delivered to the electrical load and the dimmers communicate with each other. Preferably, the dimmers communicate with each other by adjusting a firing angle.

Other features and advantages of the present invention will become apparent from the following description of the invention that refers to the accompanying drawings.

BRIEF DESCRIPTION OF THE DRAWINGS

For the purpose of illustrating the invention, there is shown in the drawings a form, which is presently preferred, it being understood, however, that the invention is not limited to the precise arrangements and instrumentalities shown. The features and advantages of the present invention will become apparent from the following description of the invention that refers to the accompanying drawings, in which.

DETAILED DESCRIPTION OF EMBODIMENTS OF THE INVENTION

Figure 1A:
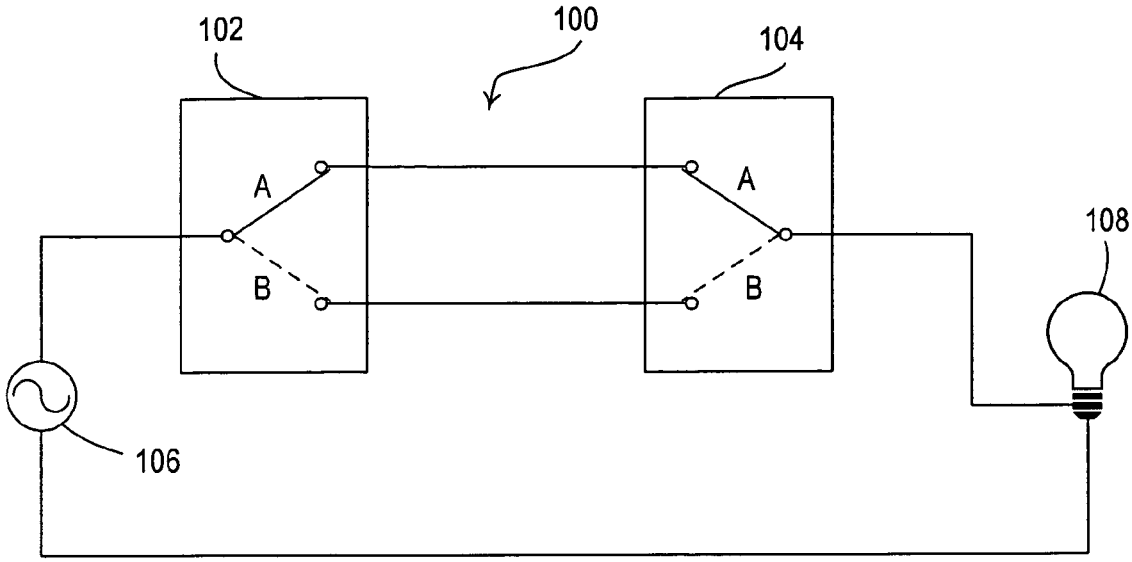
FIG. 1A PRIOR ART
FIG. 1A shows a prior art three-way switch system, which includes two three-way switches.
Figure 1B:
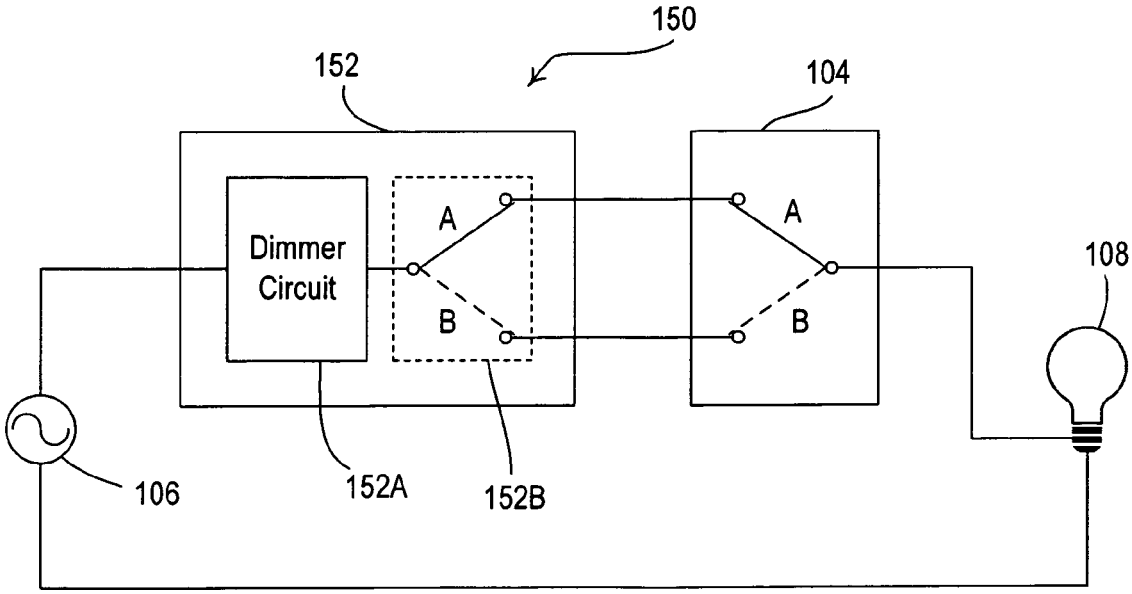
FIG. 1B PRIOR ART
FIG. 1B shows an example of a prior art three-way dimmer switch system including one prior art three-way dimmer switch and one three-way switch.
Figure 1C:
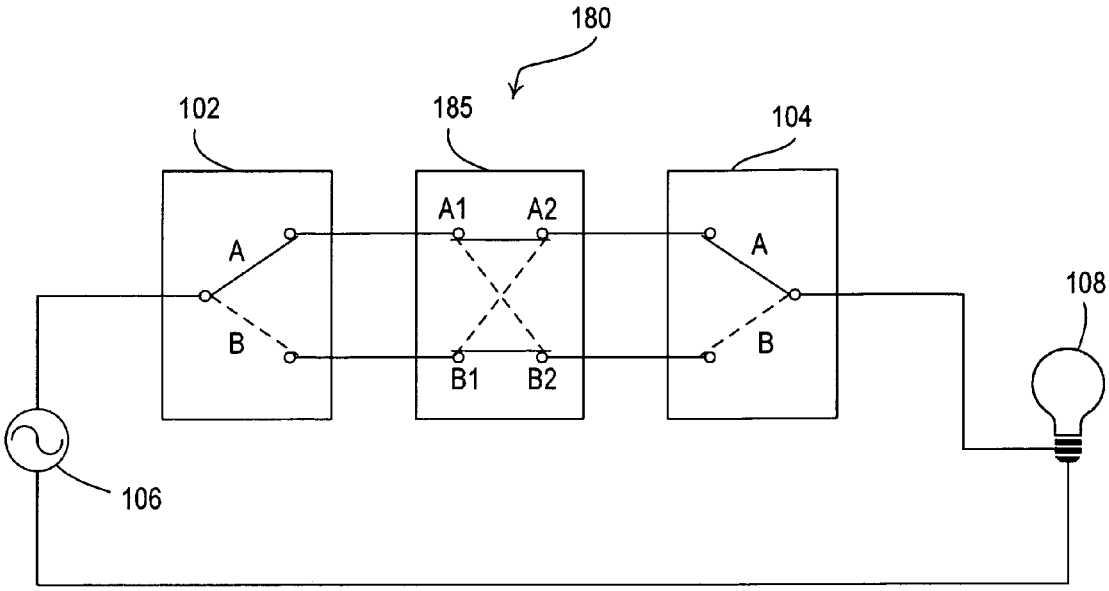
FIG. 1C PRIOR ART
FIG. 1C shows a prior art four-way switching system.
Figure 1D:
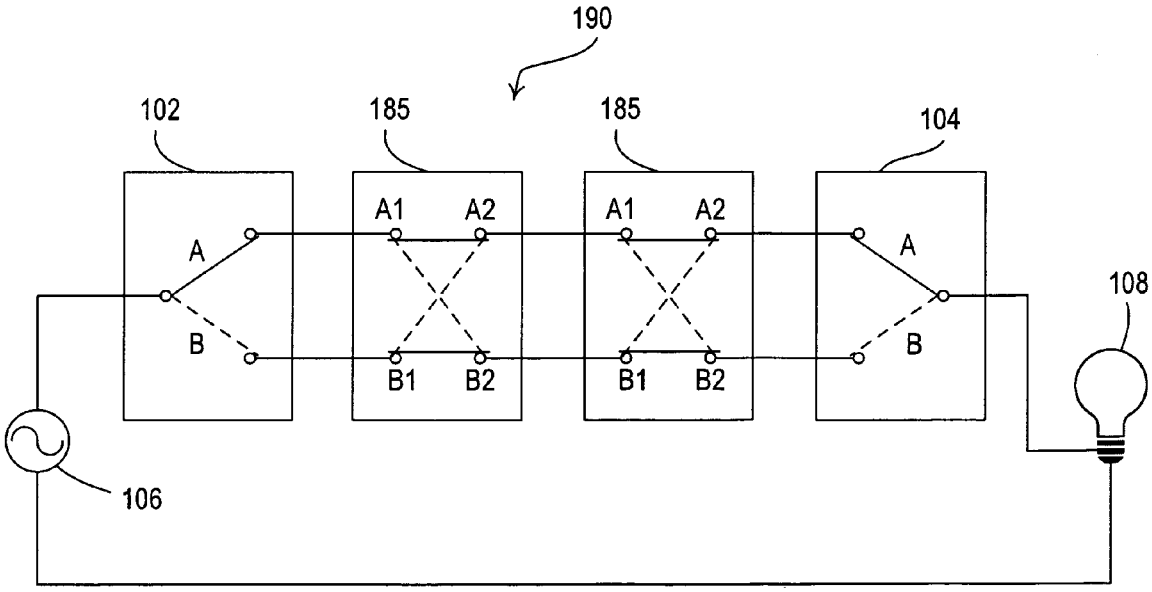
FIG. 1D PRIOR ART
FIG. 1D shows a prior art extended four-way switching system.
Figure 2:
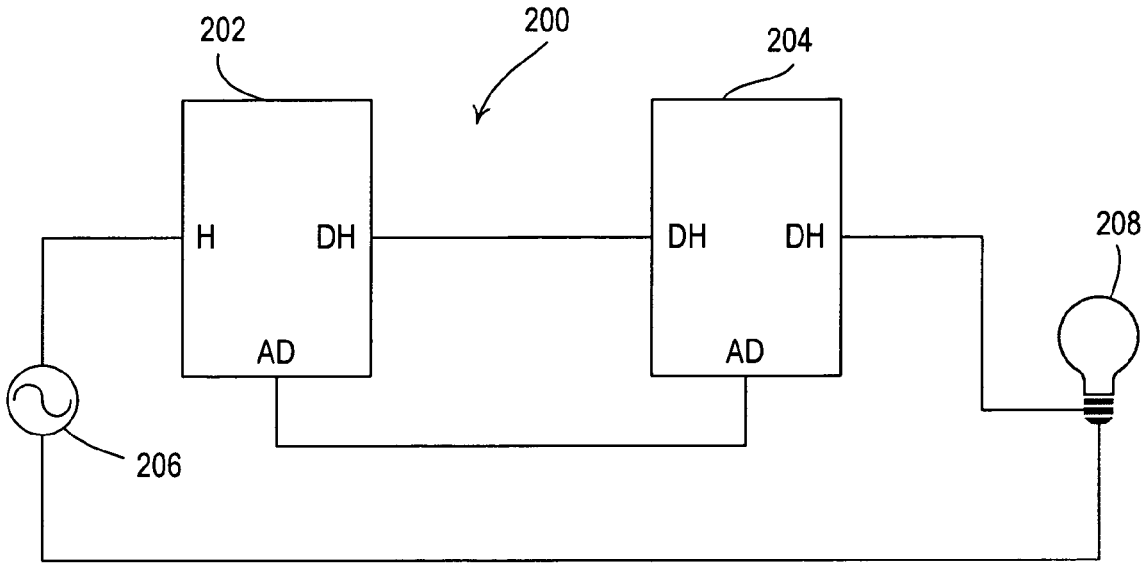
FIG. 2 PRIOR ART
FIG. 2 is a simplified block diagram of a typical prior art multiple location lighting control system.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 5:
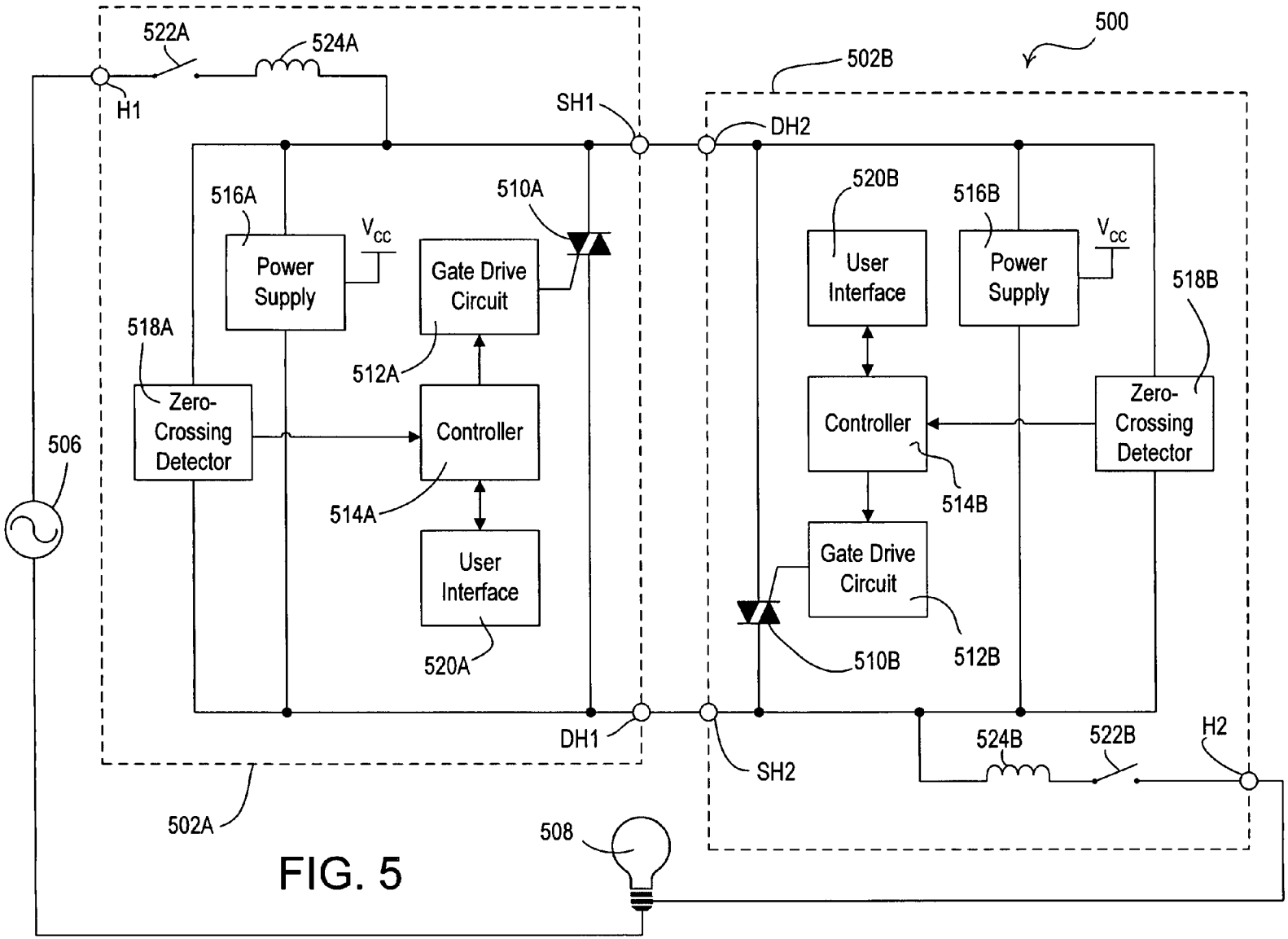
FIG. 5 is a simplified block diagram of a three-way dimming system including two smart three-way dimmers according to the present invention.

FIG. 5 is a simplified block diagram of a three-way dimming system 500 including two smart three-way dimmers 502A, 502B according to the present invention. The dimmers 502A, 502B are connected in series between an AC voltage source 506 and a lighting load 508. Note that the dimmers 502A, 502B are identical in structure, such that either of the dimmers 502A, 502B could be coupled on the line-side or the load-side of the three-way system 500. The dimmers 502A, 502B include hot terminals H1, H2 that are coupled to the AC voltage source 506 and the lighting load 508, respectively. A switched hot terminal SH1 of the first dimmer 502A is coupled to a dimmed hot terminal DH2 of the second dimmer 502B. Similarly, a switched hot terminal SH2 of the second dimmer 502B is coupled to a dimmed hot terminal DH1 of the first dimmer 502A. The terminals H1, H2, SH1, SH2, DH1, DH2 of the dimmers 502A, 502B may be screw terminals, insulated wires or "flying leads", stab-in terminals, or other suitable means of connecting the dimmer to the AC voltage source 506 and the lighting load 508.

Since the dimmers 502A, 502B are identical in structure, only dimmer 502A will be described in greater detail below. The components of dimmer 502B have similar functions and similar reference numbers to the corresponding components of dimmer 502A. The dimmer 502A comprises a bidirectional semiconductor switch 510A, which is coupled between the switched hot terminal SH1 and the dimmed hot terminal DH1. As shown in FIG. 5, the dimmer 502A implements the semiconductor switch as a triac. However, other semiconductor switching circuits may be used, such as, for example, two FETs in anti-series connection, a FET in a bridge, or one or more insulated-gate bipolar junction transistors (IGBTs). The triac 510A has a gate (or control input) that is coupled to a gate drive circuit 512A. The dimmer 502A further includes a controller 514A that is coupled to the gate drive circuit 512A to control an on-time $t_{ON}$ of the triac 510A, i.e., the period of time that the triac 510A conducts the load current, each half-cycle. The controller 514A is preferably implemented as a microcontroller, but may be any suitable processing device, such as a programmable logic device (PLD), a microprocessor, or an application specific integrated circuit (ASIC).

A power supply 516A generates a DC voltage, $V_{CC}$, to power the controller 514A. The power supply 516A is coupled across the triac 510A, i.e., from the switched hot terminal SH1 to the dimmed hot terminal DH1. The power supply 516A is able to charge by drawing a charging current through the lighting load 508 when the triac 510A is not conducting and there is a voltage potential developed across the dimmer 502A.

The dimmer 502A further includes a sensing circuit for sensing an electrical characteristic of the dimmer. The electrical characteristic may be a voltage developed across the dimmer 502A or a load current conducted through the dimmer. Specifically, the dimmer 502A comprises a zero-crossing detector 518A, i.e., a voltage monitoring circuit, which is coupled across the triac 510A. The zero-crossing detector 518A monitors the voltage across a "dimmer voltage" across the controllably conductive device 510A to determine the zero-crossings of the input AC waveform from the AC power supply 206. A zero-crossing is defined as the time at which the AC supply voltage transitions from positive to negative polarity, or from negative to positive polarity, at the beginning of each half-cycle. The zero-crossing information is provided as an input to controller 514A. The controller 514A provides the gate control signals to operate the semiconductor switch 510A to provide voltage from the AC power supply 506 to the lighting load 508 at predetermined times relative to the zero-crossing points of the AC waveform.

The controller 514A uses forward phase control dimming (or leading edge control dimming) to control the on-time $t_{ON}$ of the triac 510A and thus the intensity of the lighting load 508. With forward phase control dimming, the triac 510A is rendered conductive, i.e., turned on or "fired", at some time, i.e., a phase angle, within each AC line voltage half-cycle. The triac 510A remains on until the next line voltage zero-crossing at which time the triac is rendered non-conductive. Forward phase control dimming is often used to control energy to a resistive or inductive load, which may include, for example, a magnetic low-voltage transformer or an incandescent lamp.

Figure 6:
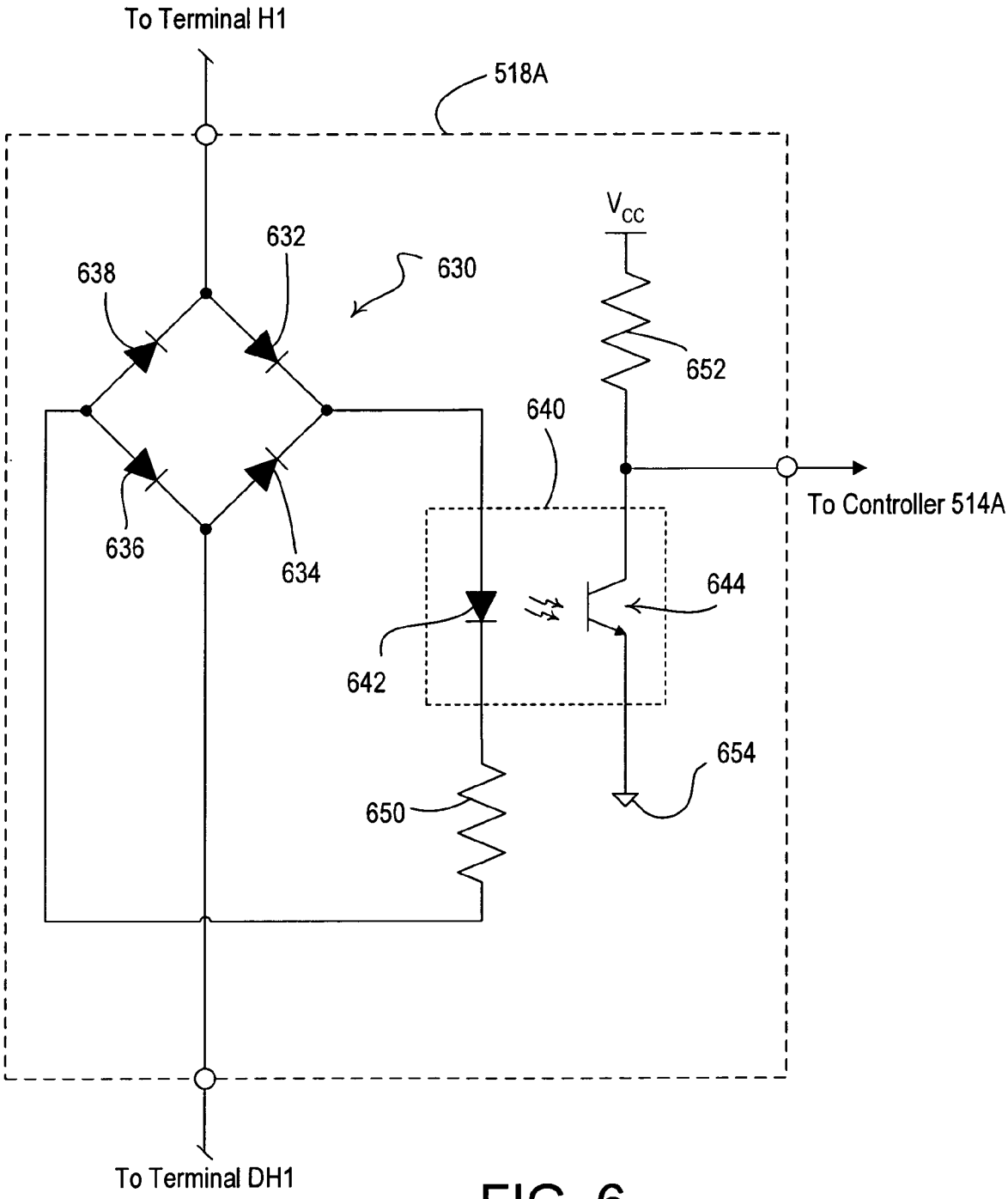
FIG. 6 is a simplified schematic diagram of a zero-crossing detector of the dimmers of FIG. 5.

FIG. 6 is a simplified schematic diagram of the zero-crossing detector 518A. The AC terminals of a full wave rectifier bridge 630 are coupled between the hot terminal H1 and the dimmer hot terminal DH1, i.e., across the triac 510A. The rectifier bridge 630 comprises four diodes 632, 634, 636, 638. The DC terminals of the rectifier bridge 630 are coupled across a photodiode 642 of an optocoupler 640 and a resistor 650. A phototransistor 644 of the optocoupler 640 is responsive to the photodiode 642. The control signal of the zero-crossing detector 518A, i.e., the output to the controller 514A, is provided at the junction of a resistor 652 and the phototransistor 644. The output of the controller 514A is coupled to the DC voltage $V_{CC}$ of the power supply 516A through the resistor 652. When there is substantially no voltage developed across the triac 510A, i.e., when the photodiode 642 is not forward biased, the output to the controller 514A is pulled up to a logic high level. When a voltage is developed across the triac 510A, an input current will flow through the photodiode 642 and the resistor 650. Accordingly, the phototransistor 644 will pull the output down to a circuit common 654, i.e., a logic low level. Thus, the control signal is the logic low level for most of the half-cycle and the logic high level at the zero-crossing. The resistor 650 preferably has a substantially large resistance, e.g., 56 kΩ, such that the magnitude of the input current through the photodiode 642 is small.

Figure 3:
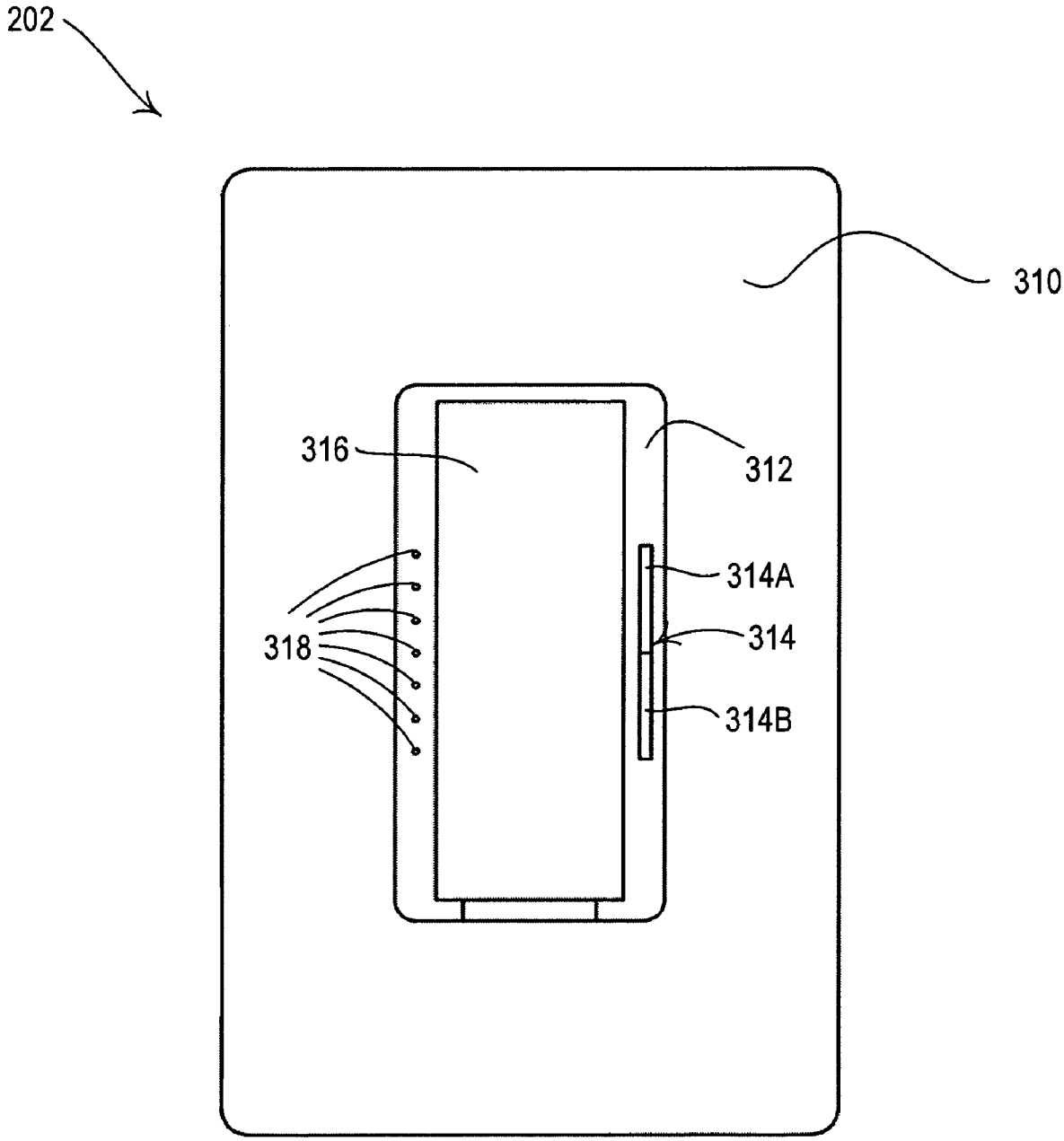
FIG. 3 PRIOR ART
FIG. 3 shows the prior art user interface of the dimmer switch of the multiple location lighting control system of FIG. 2.
Figure 4A:
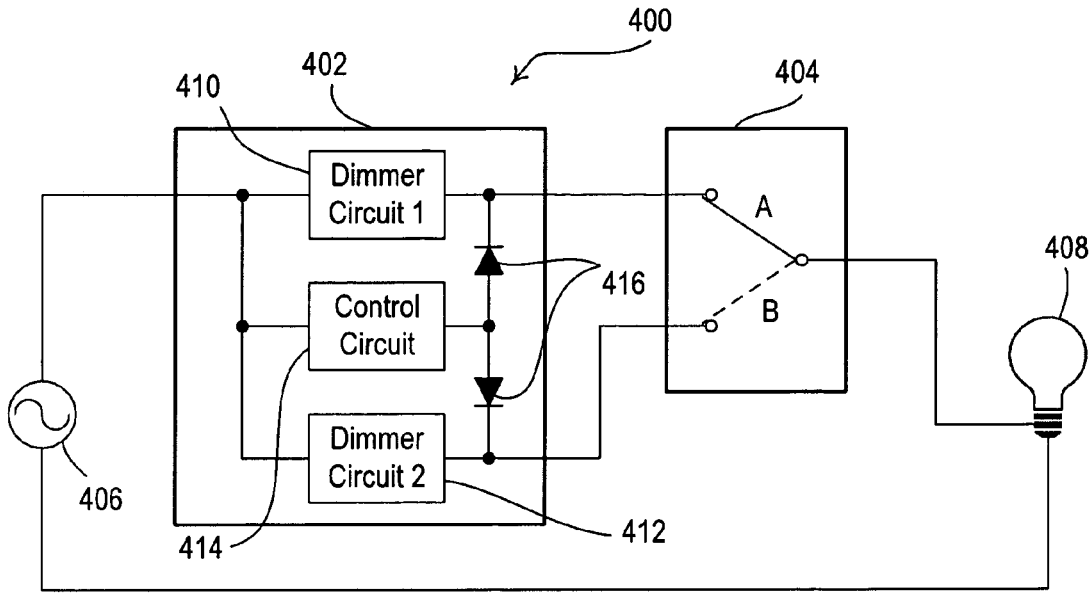
FIG. 4A PRIOR ART
FIG. 4A shows a prior art three-way system having a smart three-way dimmer.
Figure 4B:
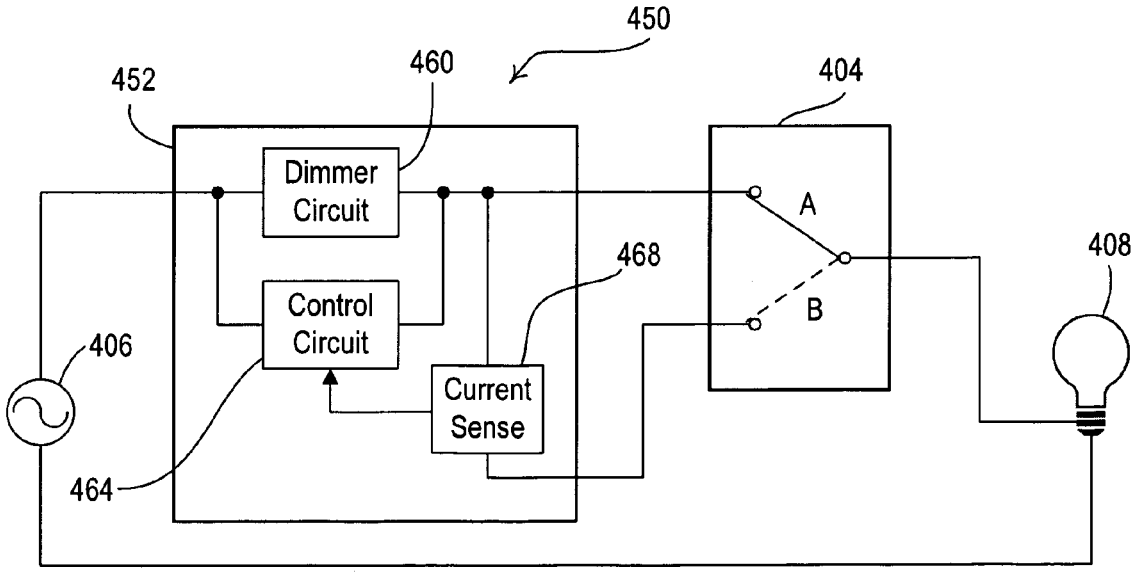
FIG. 4B PRIOR ART
FIG. 4B shows another prior art three-way system having a smart three-way dimmer.

A user interface 520A is coupled to the controller 514A and to allow a user to determine a desired lighting level (or state) of the lighting load 508. The user interface 520A provides a plurality of actuators for receiving inputs from a user, e.g., including a toggle button and an intensity actuator. In response to an actuation of the toggle button, the controller 514A will toggle the state of the lighting load 508 (i.e., from on to off and vice versa) as will be described in greater detail below. Further, the controller 514A will adjust the intensity of the lighting load 508 in response to an actuation of the intensity actuator. The user interface 520A further provides a plurality of status indicators, e.g., LEDs, to provide feedback to a user of the dimmer 502A. The status indicators are preferably arranged to display an operating characteristic of the dimmer 502A or the lighting load 508. For example, the status indicators may be arranged in a linear array (as shown in FIG. 3) to display the intensity of the lighting load 508.

The dimmers 502A, 502B include airgap switches 522A, 522B coupled to the hot terminals H1, H2 (which are preferably coupled to the AC power source 406 and the lighting load 408, respectively). Accordingly, the airgap switches 522A, 522B are each coupled between the AC power source 406 and the lighting load 408 such that if either airgap switch 522A, 522B is opened, current is prevented from flowing through the lighting load 508. The dimmers 502A, 502B further comprise inductors 524A, 524B, i.e., chokes, for providing electromagnetic interference (EMI) filtering.

According to the present invention, the triacs 510A, 510B of the dimmers 502A, 502B are coupled in parallel electrical connection between the AC source 506 and the lighting load 508. Only one of the triacs 510A, 510B will conduct the load current from the AC source 506 to the lighting load 508 at any given time. The dimmer 502A, 502B having the conducting triac 510A, 510B is consider to be in an "active" mode. Accordingly, the dimmer 502A, 502B that has the triac 510A, 510B that is not conducting current to the lighting load 508 will be in a "passive" mode. When the dimmer 502A, 502B is in the active mode, the respective controller 514A, 514B is operable to control the on-time of the conducting triac 510A, 510B to control the intensity of the lighting load 508.

As used herein, when a first device and a second device are coupled in "parallel electrical connection", a first path can be traced from the AC source 506 to the lighting load 508 through the first device, wherein the first path does not pass through the second device, and a second path can be traced from the AC source to the lighting load through the second device, wherein the second path does not pass through the first device. Accordingly, other electrical components may be coupled in series with the first and second devices such that the first and second devices are still fundamentally coupled in parallel. For example, the inductors 524A, 524B may be coupled in series with the triacs 510A, 510B, respectively, such that the series combinations of the inductors and the triacs are coupled in parallel. Further, as used herein, first dimmer and second dimmer that are coupled in "parallel electrical connection" are coupled such that their controllably conductive devices are coupled in parallel electrical connection.

When the first dimmer 502A is in the passive mode, the first controller 514A monitors the firing angle of the second triac 510B, i.e., the present intensity of the lighting load 508, by monitoring the output of the first zero-crossing detector 518A. Accordingly, the first controller 514A is operable to display the present lighting intensity of the lighting load 508 on the status indicators of the user interface 520A independent of whether the controller is presently controlling the lighting load.

According to the present invention, the dimmers 502A, 502B are operable to communicate with each other to "take control" of the lighting load 508. When the dimmer 502A, 502B is in the passive mode, the controller 502A, 502B is operable to change from the passive mode to the active mode to take control of the lighting load 508, for example, in response to an actuation of a button of the user interface 520A, 522B. To take control of the lighting load 508, the controller 502A, 502B of the dimmer 502A, 502B that is in the passive mode is operable to fire the respective triac 510A, 510B just before the triac of the dimmer that is in the active mode.

For example, if the first dimmer 502A is in the active mode and the second dimmer 502B is in the passive mode, the first controller 514A is operable to control the intensity of the lighting load 508 by turning on the triac 510A at a time approximately 5 msec after a zero-crossing of the AC line voltage. Accordingly, the triac 510A will conduct the load current for a first on-time $t_{ON1}$ of approximately 3 msec each half-cycle. To take control of the lighting load, the second controller 514B is operable to turn on the second triac 510B at a time before the first controller 514A turns on the first triac 510A, for example, at a time approximately 4.9 msec after a zero-crossing of the AC line voltage (i.e., such that a second on-time $t_{ON2}$ of the second triac 510B is 3.1 msec). The first controller 514A then determines that the second controller 514B has fired the second triac 510B by monitoring the output of the first zero-crossing detector 518A. Specifically, the dimmer voltage across the first triac 510A will be substantially zero volts if the second controller 514B has fired the second triac 510B. If the first controller 514A determines that the second triac 510B has fired, the first controller does not fire the first triac 510A during the present half-cycle. Preferably, the second controller 514B of the second dimmer 502B continues to control the conduction time of the second triac 510B with the second on-time $t_{ON2}$ for a predetermined amount of time, i.e., a predetermined number of half-cycles, e.g., three (3) half-cycles. After the predetermined amount of time, the second controller 514B will control the second triac 510B to a desired intensity level as determined from the input provided by the second user interface 522B.

FIGS. 7-10 show flowcharts of the software of the controller 514A, 514B for operating the dimmers 502A, 502B in the three-way dimming system 500 according to the present invention. The flowcharts will be described with reference to the first controller 514A, even though the second controller 514B preferably executes exactly the same software.

Figure 7:
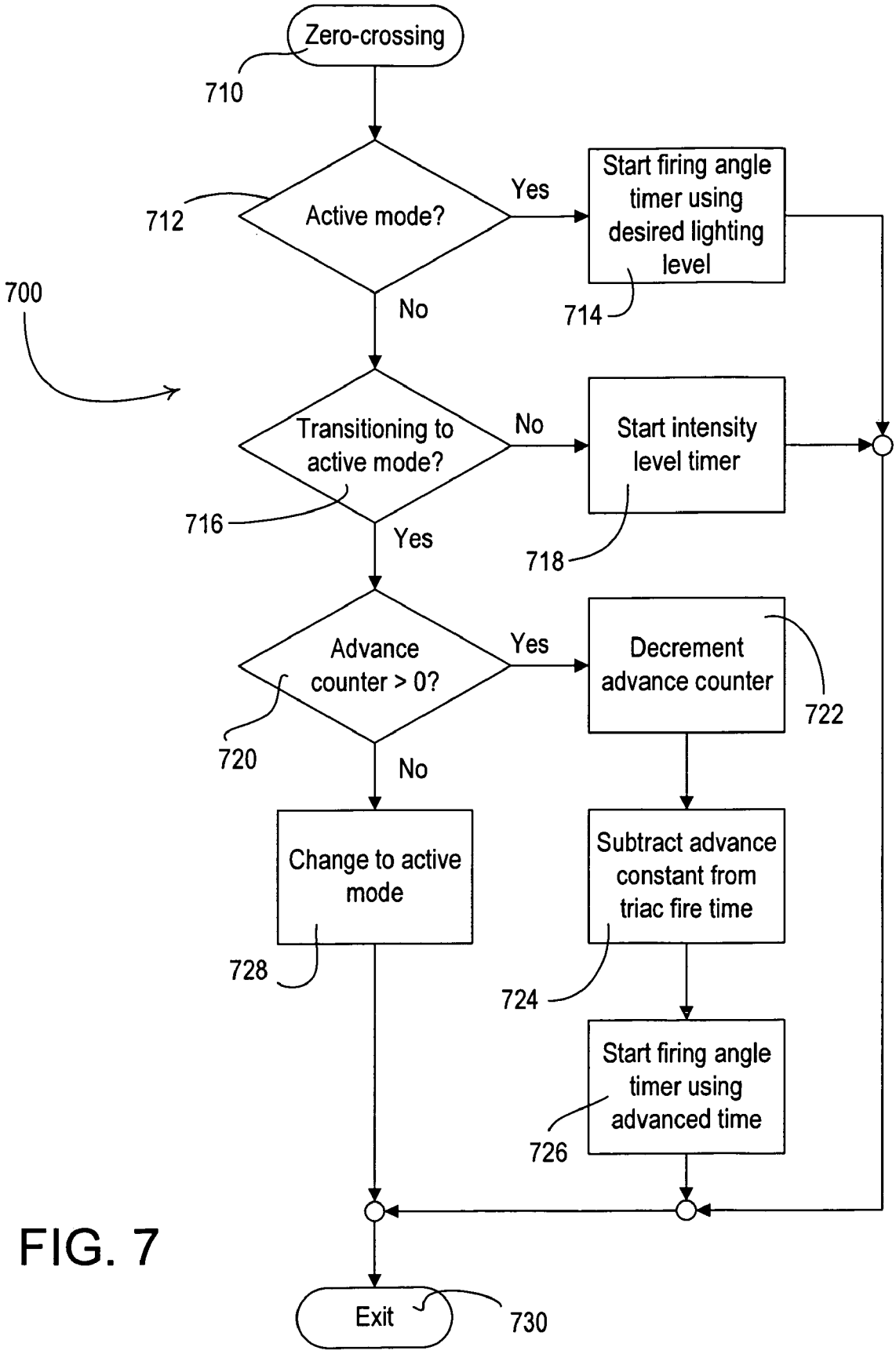
FIG. 7 is a flowchart of a zero-crossing procedure, which is executed by controllers of the dimmers of FIG. 5.

FIG. 7 is a flowchart of a zero-crossing procedure 700, which is preferably executed every half-cycle beginning at a zero-crossing of AC voltage source 506 at step 710. If the dimmer 502A is in the active mode at step 712, a firing angle timer begins decreasing at step 714 with an initial value that corresponds to a desired intensity level. The desired intensity level is generated in response to a user input, for example, from the user interface 520A and is stored in a memory of the controller 514A. When the firing angle timer expires, a fire triac interrupt request (IRQ) occurs. A triac firing procedure 900 is executed in response to the fire triac IRQ and will be described in greater detail below, with reference to FIG. 9.

When the dimmer 502A is in the passive mode, the first controller 514A determines the firing angle of the second triac 510B of the second dimmer 502B (which is in the active mode). Specifically, if the dimmer 502A is not in the active mode, i.e., in the passive mode, at step 712, a determination is made as to whether the dimmer 502A is transitioning from the passive mode to the active mode at step 716. If not, an intensity level timer is started at step 718. The intensity level timer increases in value with time and is used by an intensity level procedure 800 to calculate the firing angle of the second triac 510B of the second dimmer 502B.

Figure 8:
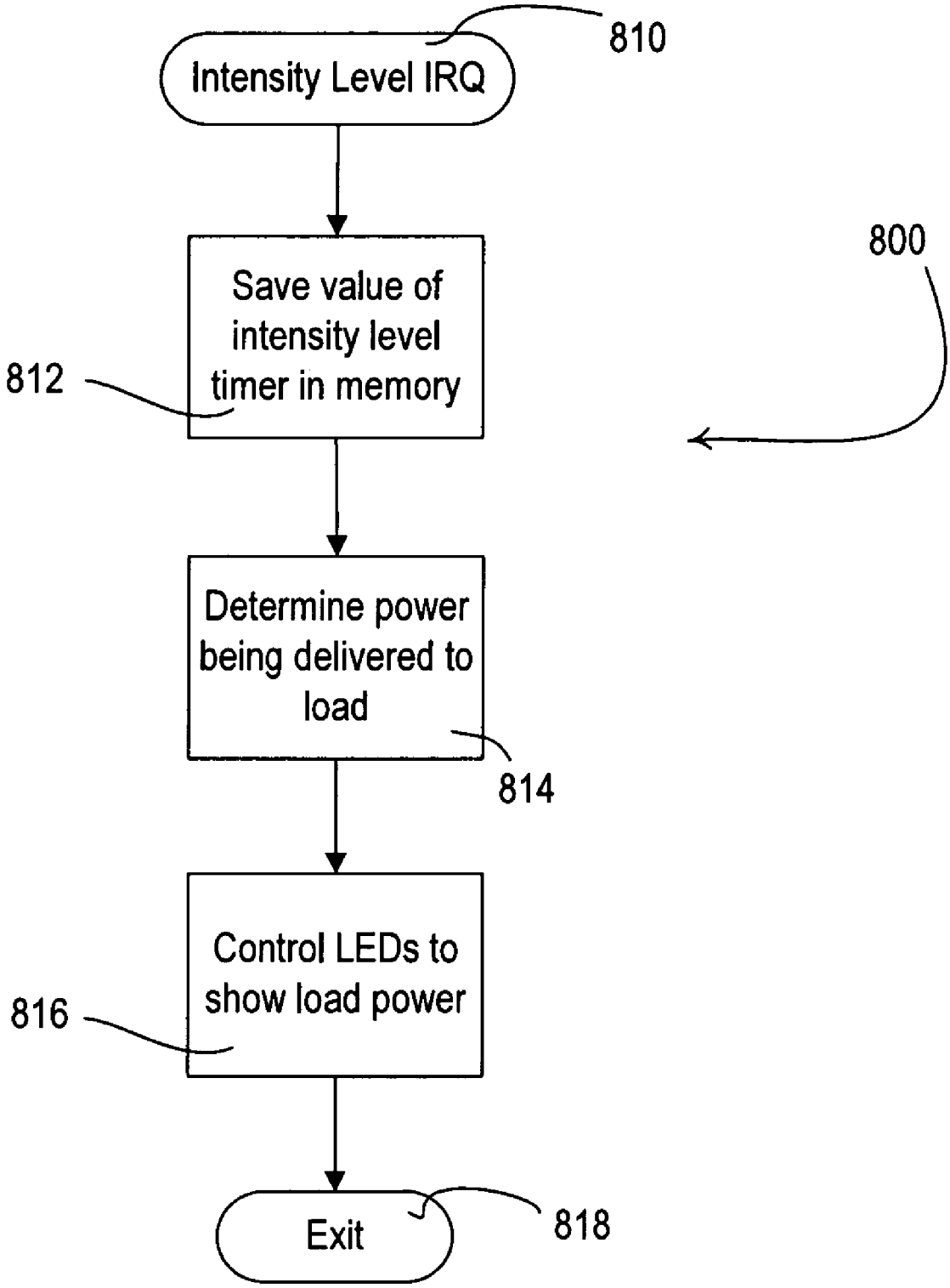
FIG. 8 is a flowchart of the intensity level procedure, which is executed by the controllers of the dimmers of FIG. 5.

FIG. 8 is a flowchart of the intensity level procedure 800, which is executed every half-cycle when the controller 514A is in the passive mode in response to an intensity level IRQ. The intensity level IRQ occurs at step 810 when the controller 514A has been signaled by the zero-crossing detector 518A that the voltage across the first triac 501A has fallen to substantially zero volts. At step 812, the controller 514A saves the value of the intensity level timer in a memory of the controller. At step 814, the controller 514A uses the value of the intensity level timer, i.e., the firing angle of the second triac 510B, to determine the amount of power being delivered to the lighting load 508, i.e., the lighting intensity of the lighting load. The controller 514A then uses the determined lighting intensity of the lighting load 508 to illuminate one or more of the status indicators of the user interface 520A to provide the intensity of the lighting 508 as feedback to a user at step 816 and exits at step 818.

While the dimmer 502A is transitioning from the passive mode to the active mode, the controller 514A will fire the first triac 510A before the second triac 510B of the second dimmer 502B for a predetermined number of half-cycles. The controller 514A uses an advance counter to keep track of how many half-cycles the dimmer 502A has fired the first triac 510A before the second triac 510B. Referring back to FIG. 7, if the dimmer 502A is transitioning from the passive mode to the active mode at step 716 and if the advance counter is greater than zero at step 720, the controller 514A decrements the advance counter by one (1) at step 722. At step 724, the controller 514A subtracts an advance constant, e.g., 100 μsec, from the calculated intensity level of the lighting load 508 (as determined in the light level procedure 800 shown in FIG. 8) to produce an advanced firing time. Next, the controller 514A starts the firing angle timer at step 726 using the advanced firing time from step 724 and the procedure 700 exits at step 730. If the advance counter has decreased to zero at step 720, the controller 514A enters the active mode at step 728 and exits the zero-crossing procedure 700 at step 730.

Figure 9:
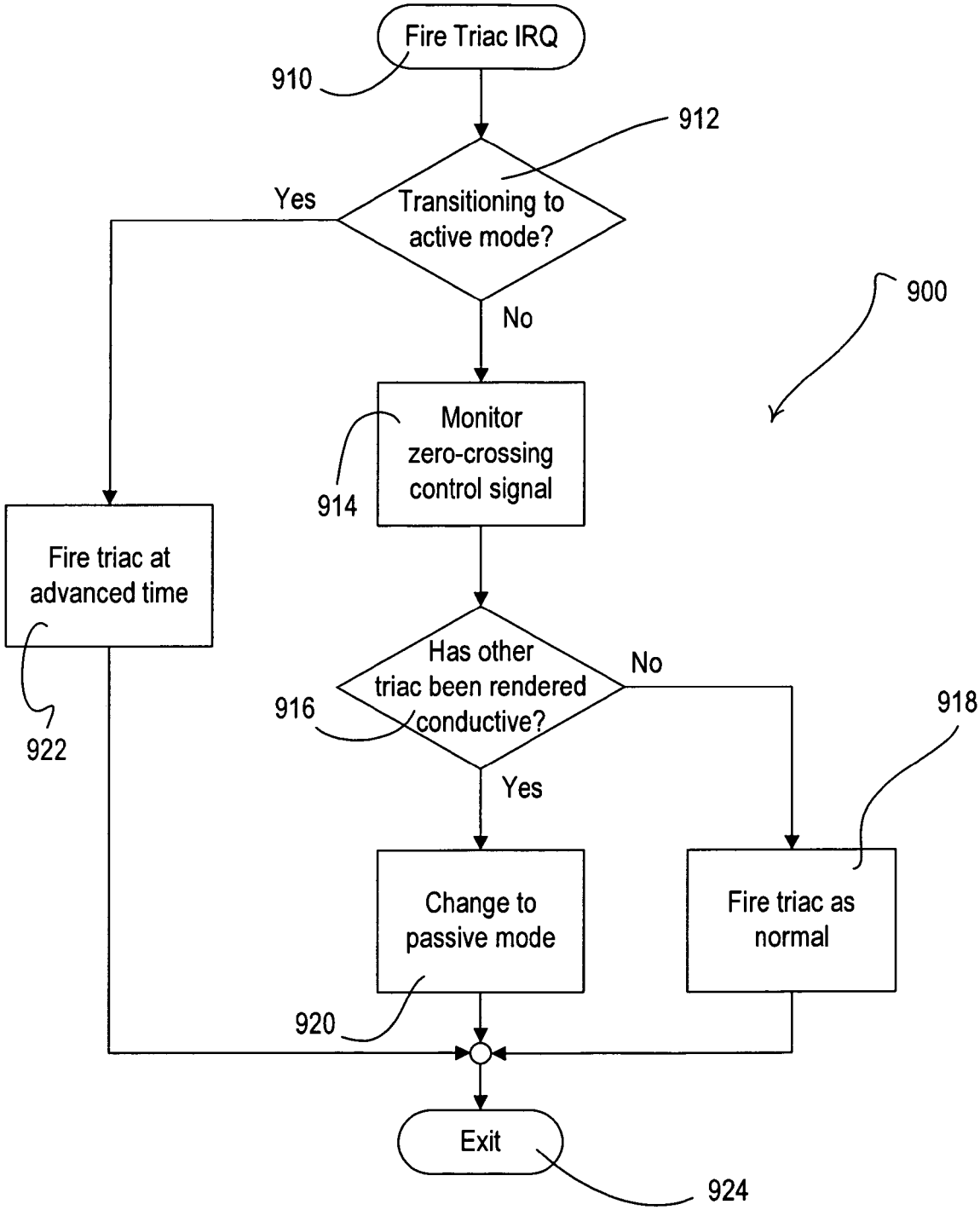
FIG. 9 is a flowchart of a triac firing procedure, which is executed by the controllers of the dimmers of FIG. 5.

FIG. 9 is a flowchart of a triac firing procedure 900, which the controller 514A preferably executes once every half-cycle in response to the fire triac interrupt request (IRQ) at step 910 when firing angle timer expires. The firing angle timer is started at steps 714 and 726 of FIG. 7. If the dimmer 502A is not transitioning to the active mode at step 912, the controller 514A monitors the output of the zero-crossing detector at step 914 to determine if the dimmer voltage across the first triac 510A is substantially zero volts, i.e., if the second triac 510B is conductive. If the second triac 510B is not conductive at step 916, the controller 514A simply fires the first triac 510A as normal at step 918 and then exits at step 924. If the second triac 510B is conductive at step 916, the controller 514A does not fire the triac 510A during the present half-cycle. The controller 514A changes to the passive mode at step 920 and exits at step 924. If the dimmer 502A is transitioning to the active mode at step 912, the controller 514A fires the triac 510A at the advanced time to take control of the lighting load 508 at step 922 and exits at step 924.

Figure 10:
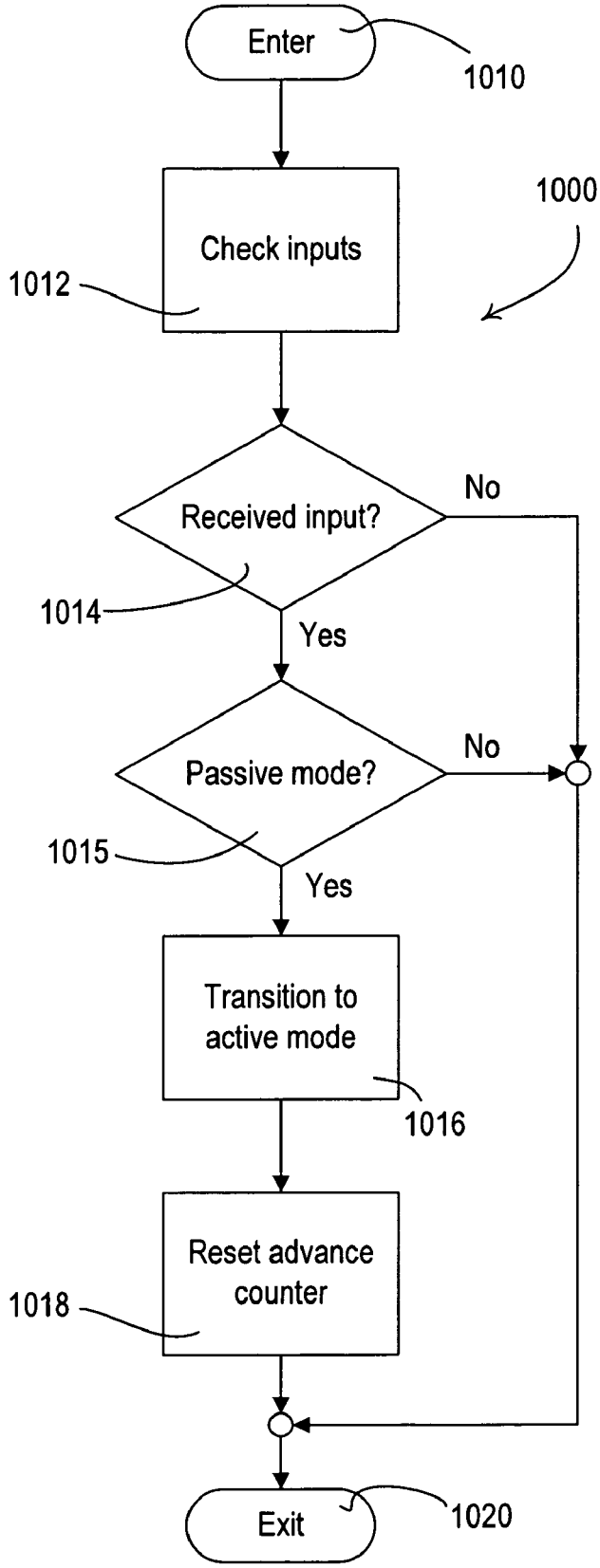
FIG. 10 is a flowchart of an input monitor procedure, which is executed by the controllers of the dimmers of FIG. 5.

FIG. 10 is a flowchart of an input monitor procedure 1000, which is preferably executed once every half cycle and begins at step 1010. At step 1012, the controller 514A checks the inputs, for example, inputs provided from the user interface 520A. If no inputs are received at step 1014, the procedure 1000 simply exits at step 1022. Otherwise, if the dimmer 502A is in the passive mode at step 1015, the controller 514A begins to transition to the active mode at step 1016. At step 1018, the controller 514A initializes the advance counter to a maximum advance counter value, e.g., three, such that the controller fires the first triac 510A before the second triac 510B for three half-cycles while transitioning to the active mode. Next, the controller 514 processes the input accordingly at step 1020 and exits at step 1022.

Figure 11:
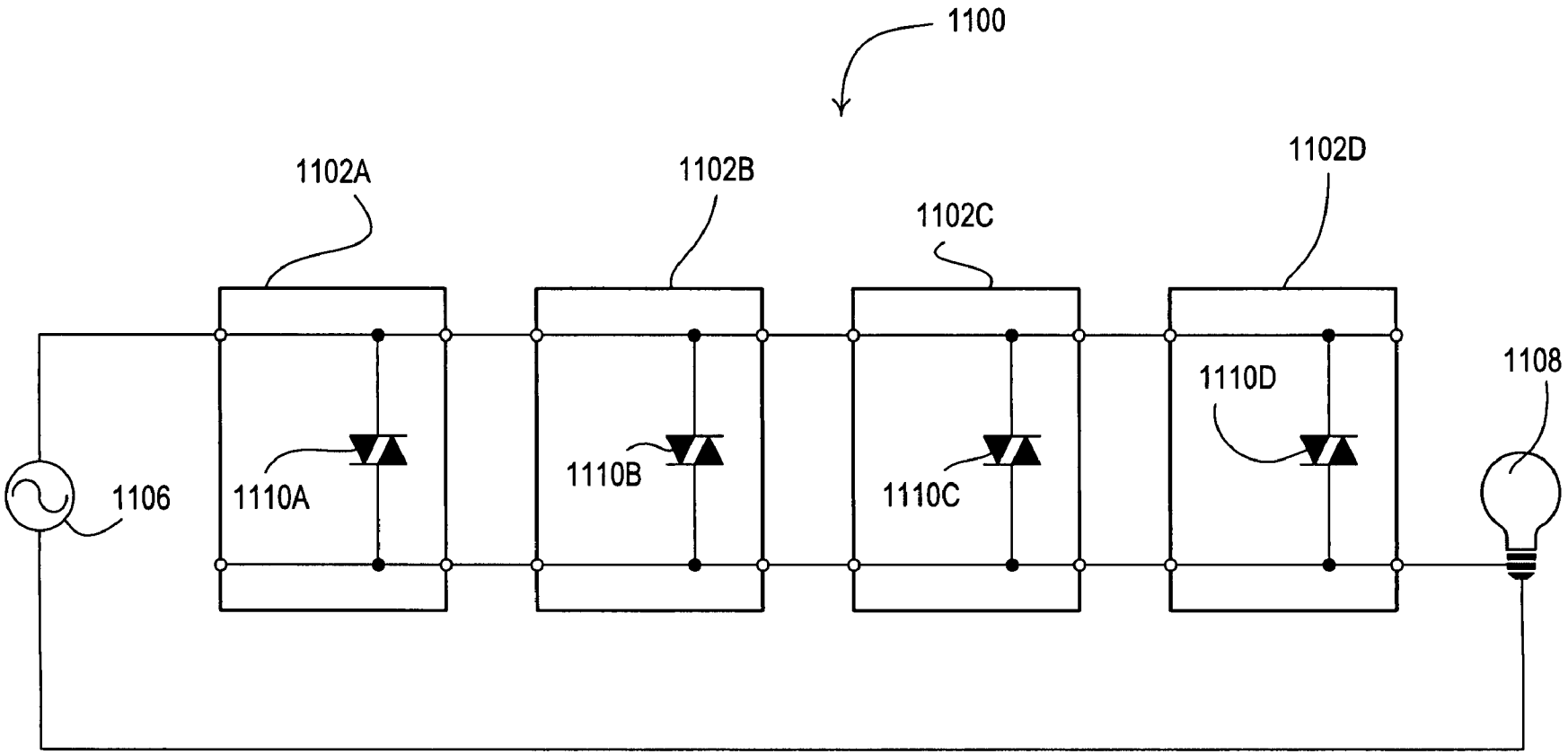
FIG. 11 is a simplified block diagram of a multiple location dimming system having four smart dimmers, each having four load terminals.

While the present invention has been described with reference to the three-way dimming system 500 shown in FIG. 5, the present invention is not limited to including only two dimmers 502A, 502B. FIG. 11 is a simplified block diagram of a multiple location dimming system 1100 having four smart dimmers 1102A, 1102B, 1102C, 1102D according to the present invention. Each dimmer 1102A, 1102B, 1102C, 1102D has a controllably conductive device, e.g., a triac 1110A, 1110B, 1110C, 1110D. The triacs 1110A, 1110B, 1110C, 1110D are coupled in parallel electrical connection between an AC power source 1106 and a lighting load 1108, such that each triac is able to control the intensity of the lighting load. As shown in FIG. 11, each dimmer 1102A, 1102B, 1102C, 1102D has four terminals to allow for simple connection between the dimmers. Each of the dimmers 1102A, 1102B, 1102C, 1102D includes a power supply (not shown), which is operable to charge by drawing a charging current through the lighting load 1108. Preferably, the charging current of each power supply is substantially small, such that the sum of the charging currents of each of the power supplies is not large enough the illuminate the lighting load 1108.

Only one of the dimmers 1102A, 1102B, 1102C, 1102D may be in the active mode, i.e., controlling the lighting load 1108, at a given time, while the other three dimmers are in the passive mode. As with the system 500 shown in FIG. 5, one of the dimmers 1102A, 1102B, 1102C, 1102D in the passive mode may temporarily increase the firing angle provided to the lighting load 1108 to take control of the lighting load. The present invention is not limited to including only four dimmers as shown in FIG. 11. Since the triacs of the dimmers are provided in parallel electrical connection, more dimmers can be added to the system 1100.

Figure 12:
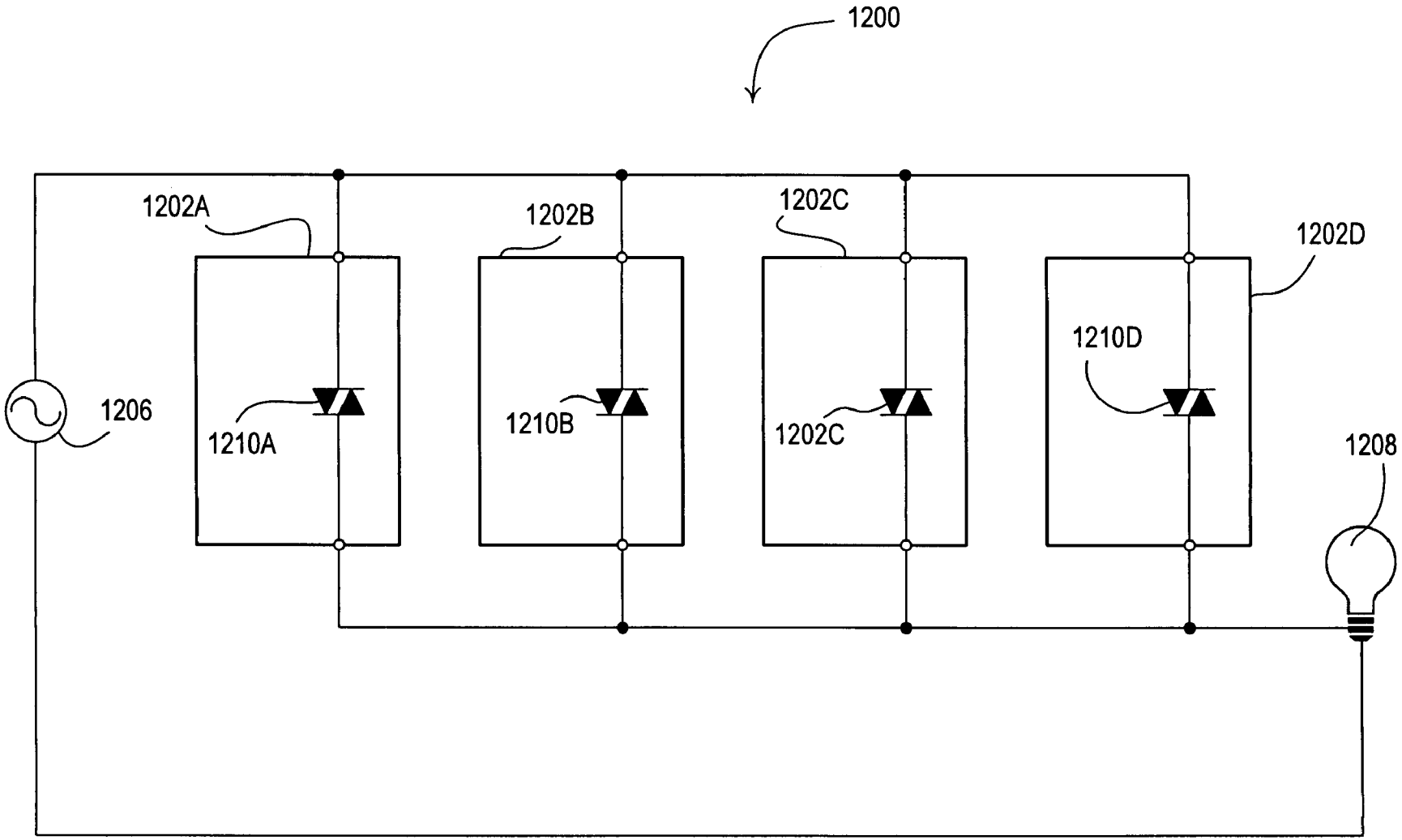
FIG. 12 is a simplified block diagram of a multiple location dimming system having four smart dimmers, each having two load terminals.

FIG. 12 is a simplified block diagram of a multiple location dimming system 1200 having a plurality of smart dimmers 1202A, 1202B, 1202C, 1202D, each having only two terminals. Each dimmer 1202A, 1202B, 1202C, 1202D has a controllably conductive device, e.g., a triac 1210A, 1210B, 1210C, 1210D. The triacs 1210A, 1210B, 1210C, 1210D are coupled in parallel electrical connection between an AC power source 1206 and a lighting load 1208, such that each triac is able to control the intensity of the lighting load. The dimmers 1202A, 1202B, 1202C, 1202D operate in a similar fashion to the dimmers of the other systems 500, 1100 described.

Figure 13:
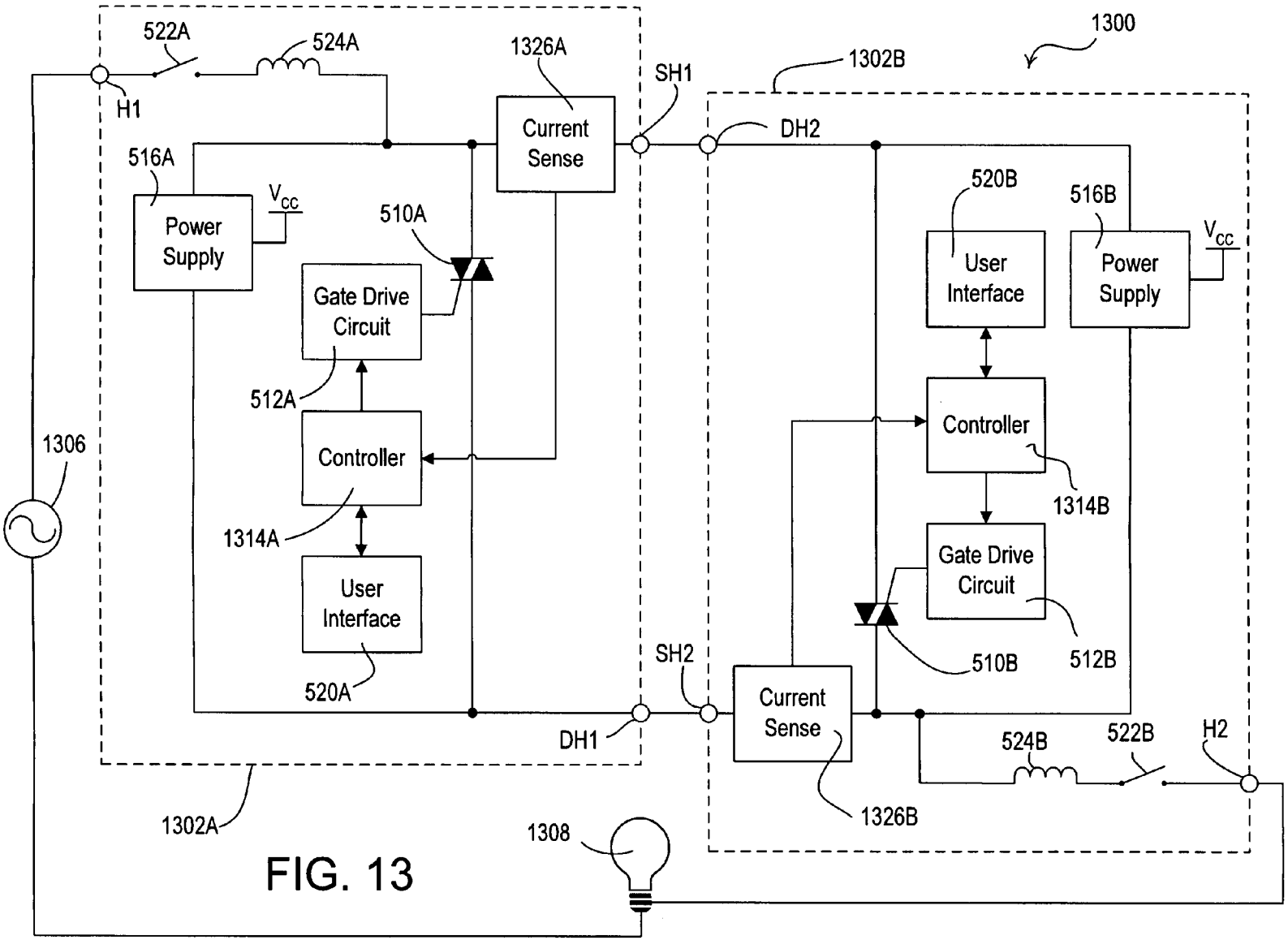
FIG. 13 is a simplified block diagram of a three-way dimming system including two smart three-way dimmers according to another embodiment of the present invention.

FIG. 13 is a simplified block diagram of a three-way dimming system 1300 according to another embodiment of the present invention. The system 1300 comprises two dimmers 1302A, 1302B coupled between an AC power source 1306 and a lighting load 1308 for individual control of the amount of power delivered to the lighting load. The dimmers 1302A, 1302B include current sense circuits 1326A, 1326B, which are coupled in series with the switched hot terminals SH1, SH2, respectively, and both provide a control signal to a controller 1314A. When the dimmers 1302A, 1302B are in the passive mode, the current sense circuit 1326A, 1326B provide control signals representative of the firing angle of the triac 510A, 510B in the other triac. For example, when first dimmer 1302A is in the passive mode, the first current sense circuit 1326A is operable to sense the rising edge of the load current through the switched hot terminal S1 when the second triac 510B fires. Even though the flowcharts of the software executed by the controller 1314A are not shown in the present application, the controller logic for this embodiment is substantially similar to the flowcharts shown in FIGS. 7-10.

Figure 14:
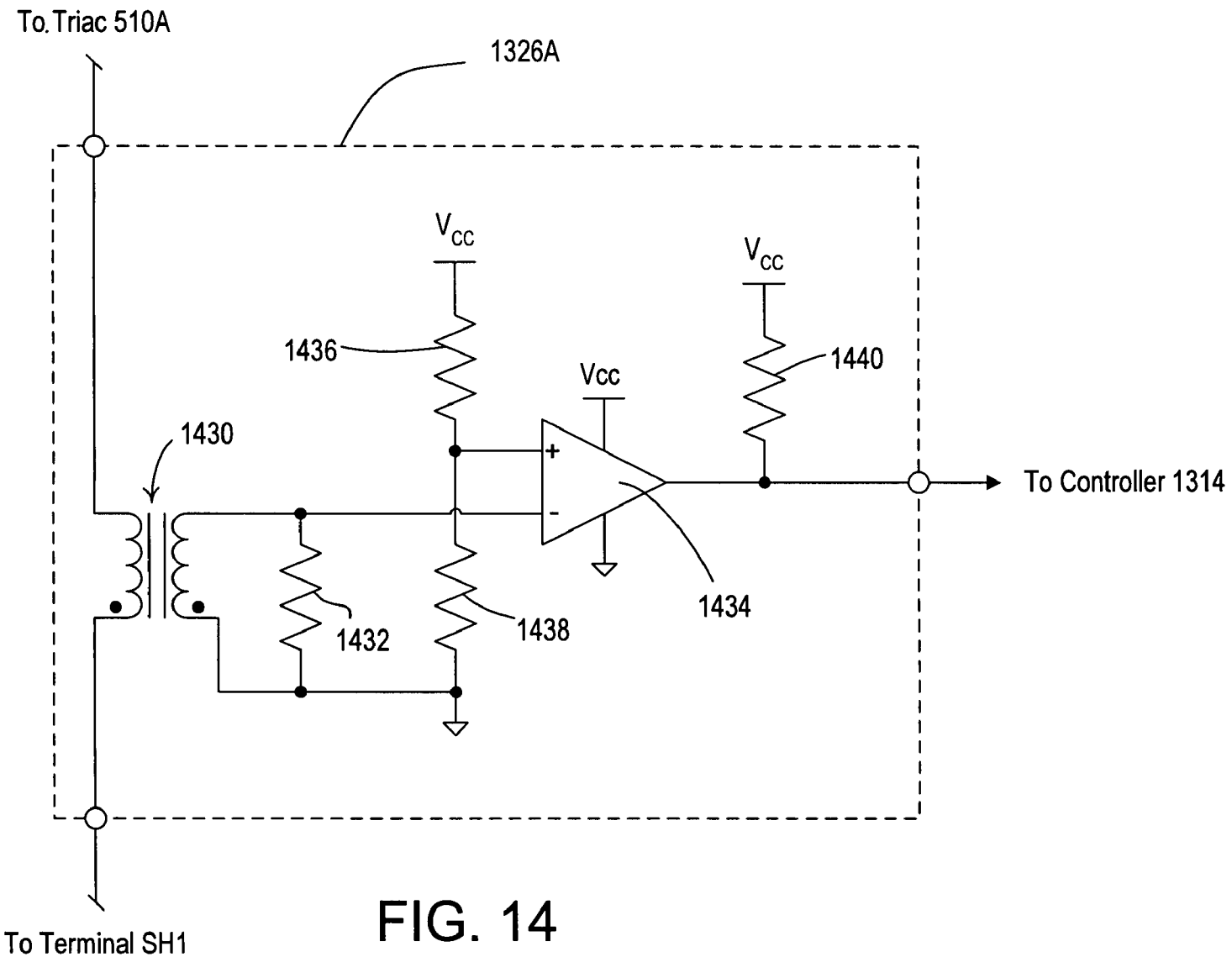
FIG. 14 is a simplified schematic diagram of a current sense circuit of the smart three-way dimmers of FIG. 13.

FIG. 14 is a simplified schematic diagram of the current sense circuit 1326A. The current sense circuit 1326A includes a current sense transformer 1430 that has a primary winding coupled in series between the switched hot terminal SH1 and the junction of the triac 510A and the inductor 524A. The current sense transformer 1430 only operates above a minimum operating frequency, such that current only flows in the secondary winding when the current waveform through the primary winding has a frequency above the minimum operating frequency. Preferably, the current sense transformer 1430 detects the rising edge of the load current through the second triac 510B of the second dimmer 502B. Since the load current will increase very quickly when the second triac 510B fires (i.e., the load current has a high-frequency component), a current will flow in the secondary winding of the current sense transformer when the second triac 510B fires.

The secondary winding of the current sense transformer 1430 is coupled across a resistor 1432. The resistor 1432 is further coupled between circuit common and the negative input of a comparator 1434. A reference voltage is produced by a voltage divider comprising two resistors 1436, 1438 and is provided to the positive input of the comparator 1434. The output of the comparator 1434 is tied to the DC voltage $V_{CC}$ of the power supply 516A through a resistor 1440 and is coupled to the controller 1314A. When current flows through the secondary winding of the current sense transformer 1430, a voltage is produced across the resistor 1432 that exceeds the reference voltage. The comparator 1434 then drives the output low, signaling to the controller 1314A that current has been sensed. Alternatively, the current detect circuit 1326A may be implemented using an operational amplifier or a discrete circuit comprising one or more transistors rather than the comparator 1434.

Figure 15:
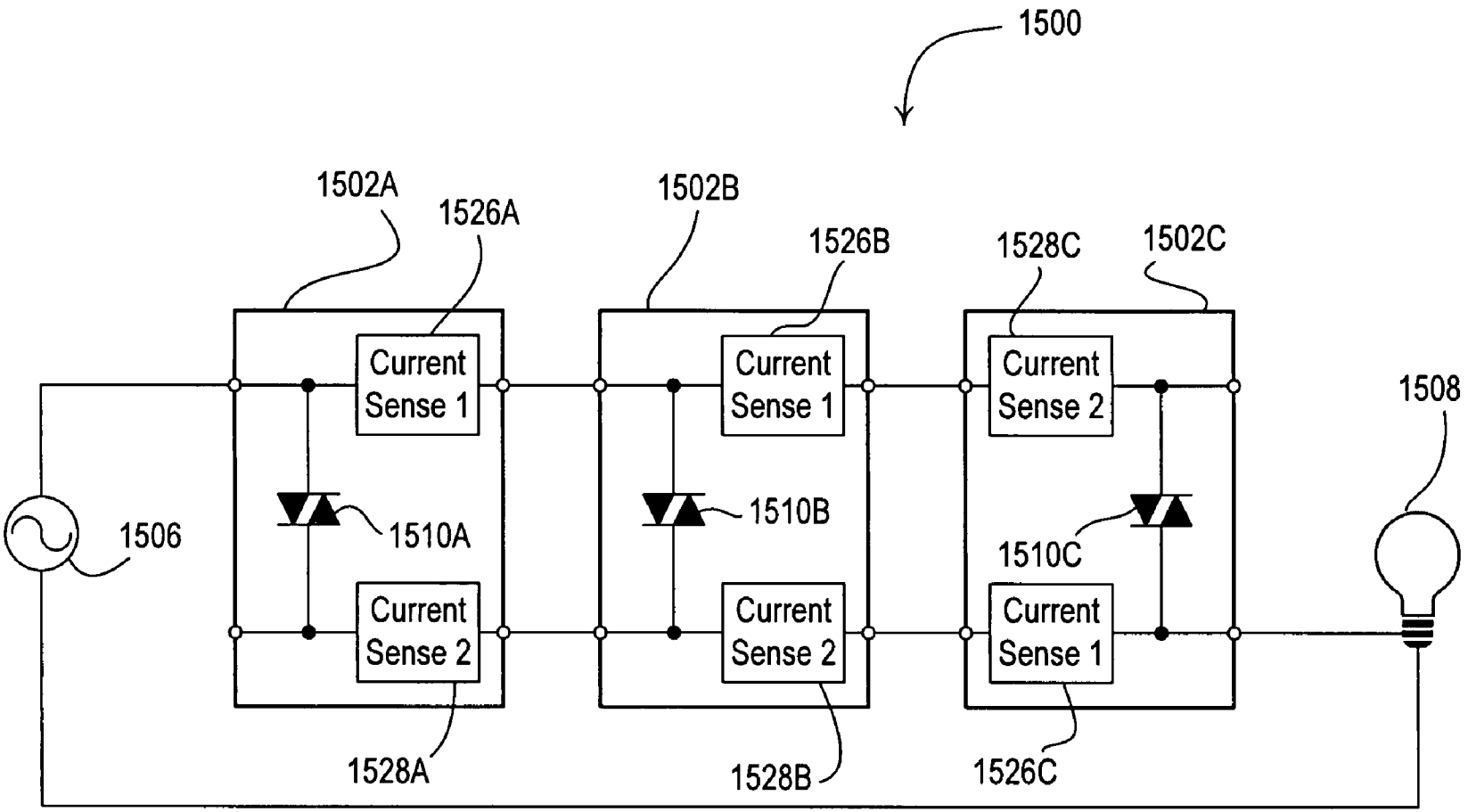
FIG. 15 is a simplified block diagram of a multiple location dimming system having three smart dimmers, each having four load terminals and two current sense circuits.

FIG. 15 is a simplified block diagram of another multiple location dimming system 1500. The system 1500 comprises a plurality of dimmers 1502A, 1502B, 1502C coupled between an AC source 1506 and a lighting load 1508. Each of the dimmers 1502A, 1502B, 1502C comprises a triac 1510A, 1510B, 1510C operable to control the amount of power delivered to the lighting load 1508. Since the dimmers 1502A, 1502B, 1502C each comprise four load terminals, each of the dimmers comprises a first current sense circuit 1526A, 1526B, 1526C and a second current sense circuit 1528A, 1528B, 1528C, respectively. Each of the first and second current sense circuits is responsive to the rising edge of the load current flowing through the respective current sense circuit. For example, the dimmer 1502B is operable to sense the firing angle of the load current through the triac 1510A through the second current sense circuit 1528B or the load current through the triac 1510C through the first current sense circuit 1526B.

Although the words "device" and "unit" have been used to describe the elements of the dimming systems of the present invention, it should be noted that each "device" and "unit" described herein need not be fully contained in a single enclosure or structure. For example, the dimmer 502A of FIG. 5 may comprise a plurality of buttons in a wall-mounted enclosure and a controller that is included in a separate location. Also, one "device" may be contained in another "device". For example, the semiconductor switch (i.e., the controllably conductive device) is a part of the dimmer of the present invention.

Although the present invention has been described in relation to particular embodiments thereof, many other variations and modifications and other uses will become apparent to those skilled in the art. Therefore, the present invention should not be limited by the specific disclosure herein.

What is claimed is:

1. A multiple location dimming system for controlling the power delivered to an electrical load from an AC power source, the system comprising:

a first dimmer coupled between the AC power source and the electrical load, the first dimmer comprising a first controllably conductive device for controlling the amount of power delivered to the electrical load and a first controller coupled to the first controllably conductive device for control of the first controllable conductive device, the first controller operable to monitor a first electrical characteristic of the first dimmer; and a second dimmer coupled between the AC power source and the electrical load, the second dimmer comprising a second controllably conductive device for controlling the amount of power delivered to the electrical load and a second controller coupled to the second controllably conductive device for control of the second controllably conductive device, the second controller operable to monitor a second electrical characteristic of the second dimmer;

wherein the first dimmer is coupled to the second dimmer such that the first controllably conductive device is coupled in parallel electrical connection with the second controllably conductive device, the parallel combination of the first and second controllably conductive devices in series electrical connection between the AC power source and the electrical load; and wherein the first controller is operable to render the first controllably conductive device conductive at a first time each half-cycle of the AC power source, the second controller operable to determine the first time in response to the second electrical characteristic, and to render the second controllably conductive device conductive at a second time before the first time during a first half-cycle, the first controller operable to determine whether the second controller has rendered the second controllably conductive device conductive before the first time during the first half-cycle, and to render the first controllably conductive device non-conductive in response to determining that the second controller rendered the second controllably conductive device conductive before the first time during the first half-cycle.

2. The system of claim 1, wherein the first and second electrical characteristics comprise first and second dimmer voltages developed across the first and second controllably conductive devices, respectively.

3. The system of claim 2, wherein the first dimmer comprises a first voltage monitoring circuit for generating a first control signal representative of the magnitude of the first dimmer voltage, and the second dimmer comprises a second voltage monitoring circuit for generating a second control signal representative of the magnitude of the second dimmer voltage.

4. The system of claim 1, wherein the second controller is operable to render the second controllably conductive device conductive at the second time for a predetermined number of half-cycles after the first half-cycle.

5. The system of claim 1, wherein the second dimmer further comprises an actuator, the second controller operable to render the second controllably conductive device conductive at the second time in response to an actuation of the actuator.

6. The system of claim 1, wherein the second dimmer further comprises a status indicator coupled to the second controller, the second controller operable to control the status indicator in response to the first time.

7. The system of claim 1, wherein the first controller is operable to render the first controllably conductive device conductive at a first time each half-cycle of the AC power source and to determine whether the first dimmer voltage is a substantially low voltage at approximately the first time.

8. The system of claim 7, wherein the first controller is operable to determine whether the first dimmer voltage is a substantially low voltage before the first time, and to determine whether to render the first controllably conductive device conductive in response to the determination as to whether the first dimmer voltage is a substantially low voltage.

9. The system of claim 1, wherein the first electrical characteristic comprises a second load current conducted through the second controllably conductive device, and the second electrical characteristic comprises a first load current conducted through the first controllably conductive device.

10. The system of claim 9, wherein the first dimmer comprises a first current sense circuit operable to conduct the second load current and the second dimmer comprises a second current sense circuit operable to conduct the first load current.

11. The system of claim 9, wherein the first controller is operable to render the first controllably conductive device conductive at a first time each half-cycle of the AC power source and the second controller is operable to determine the first time in response to the second load current.

12. The system of claim 1, wherein the first and second controllably conductive devices comprise bidirectional semiconductor switches.

13. The system of claim 12, wherein the bidirectional semiconductor switches comprise a triac.

14. The system of claim 12, wherein the bidirectional semiconductor switches each comprise two field-effect transistors in anti-series connection.

15. The system of claim 1, further comprising:

a plurality of dimmers, each having a controllably conductive device, the controllably conductive devices of the plurality of dimmers coupled in parallel electrical connection.

16. A multiple location dimming system for controlling the power delivered to an electrical load from an AC power source, the system comprising:

a first dimmer coupled between the AC power source and the electrical load, the first dimmer comprising a first controllably conductive device for controlling the amount of power delivered to the electrical load and a first controller coupled to the first controllably conductive device for control of the first controllably conductive device, the first controller operable to monitor a first electrical characteristic of the first dimmer; and a second dimmer coupled between the AC power source and the electrical load, the second dimmer comprising a second controllably conductive device for controlling the amount of power delivered to the electrical load and a second controller coupled to the second controllably conductive device for control of the second controllably conductive device, the second controller operable to monitor a second electrical characteristic of the second dimmer;

wherein the first dimmer is coupled to the second dimmer such that the first controllably conductive device is coupled in parallel electrical connection with the second controllably conductive device, the parallel combination of the first and second controllably conductive devices in series electrical connection between the AC power source and the electrical load; and wherein the first controller is operable to render the first controllably conductive device conductive for a first period of time each half-cycle of the AC power source and the second controller is operable to determine the first period of time of the first controllably conductive device in response to the second electrical characteristic.

17. The system of claim 16, wherein the second controller is operable to render the second controllably conductive device conductive for a second period of time greater than the first period of time.

18. The system of claim 17, wherein the first controller is operable to determine whether the second controller has rendered the second controllably conductive device conductive for the second period of time, and to render the first controllably conductive device non-conductive in response to the second controller rendering the second controllably conductive device conductive for the second period of time.

19. The system of claim 18, wherein the second controller is operable to render the second controllably conductive device conductive for the second period of time for a predetermined number of half-cycles.

20. The system of claim 16, wherein the first and second dimmers each comprise at least one status indicator for displaying a status of the electrical load.

21. A multiple location dimming system for controlling the power delivered to an electrical load from an AC power source, the system comprising:

a first dimmer coupled between the AC power source and the electrical load, the first dimmer comprising a first controllably conductive device operable to control the amount of power delivered to the electrical load by conducting load current from the AC power source to the electrical load at a first time each half-cycle of the AC power source; and a second dimmer coupled between the AC power source and the electrical load, the second dimmer comprising a second controllably conductive device operable to control the amount of power delivered to the electrical load, the second dimmer coupled to the first dimmer such that the second controllably conductive device is coupled in parallel electrical connection with the first controllably conductive device, the parallel combination of the first and second controllably conductive devices in series electrical connection between the AC power source and the electrical load, only one of the first and the second controllably conductive devices operable to conduct the load current at a given time;

wherein the second dimmer is operable to render the second controllably conductive device conductive at a second time before the first time; and wherein the first dimmer is operable to render the first controllably conductive device non-conductive in response to the second dimmer rendering the second controllably conductive device conductive at the second time.

* * * * *